US008672060B2

(12) United States Patent
Centala et al.

(10) Patent No.: US 8,672,060 B2
(45) Date of Patent: Mar. 18, 2014

(54) HIGH SHEAR ROLLER CONE DRILL BITS

(75) Inventors: Prabhakaran K. Centala, The Woodlands, TX (US); Zhehua Zhang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 375 days.

(21) Appl. No.: 12/844,526

(22) Filed: Jul. 27, 2010

(65) Prior Publication Data

US 2011/0024197 A1 Feb. 3, 2011

Related U.S. Application Data

(60) Provisional application No. 61/230,497, filed on Jul. 31, 2009, provisional application No. 61/330,532, filed on May 3, 2010.

(51) Int. Cl.
*E21B 10/08* (2006.01)
*E21B 10/18* (2006.01)
*E21B 10/22* (2006.01)

(52) U.S. Cl.
USPC ..... 175/336; 175/359; 175/371; 175/376

(58) Field of Classification Search
USPC ..... 175/336, 327, 349, 355, 359, 371, 376
See application file for complete search history.

(56) References Cited

U.S. PATENT DOCUMENTS

| | | | |
|---|---|---|---|
| 334,594 | A | 1/1886 | Maloy |
| 1,026,886 | A | 5/1912 | Maloy |
| 1,124,241 | A | 1/1915 | Hughes |
| 1,124,242 | A | 1/1915 | Hughes |
| 1,124,243 | A | 1/1915 | Hughes |
| 1,131,701 | A | 3/1915 | Hughes |
| 1,143,273 | A | 6/1915 | Hughes |
| 1,143,274 | A | 6/1915 | Hughes |
| 1,143,275 | A | 6/1915 | Hughes |
| 1,182,533 | A | 5/1916 | Double |

(Continued)

FOREIGN PATENT DOCUMENTS

| | | | |
|---|---|---|---|
| DE | 19521447 | A1 | 12/1996 |
| GB | 2167107 | A | 5/1986 |

(Continued)

OTHER PUBLICATIONS

International Search Report with Written Opinion issued in International Application No. PCT/US2010/043603 dated Mar. 2, 2011 (8 pages).

(Continued)

*Primary Examiner* — Jennifer H Gay
(74) *Attorney, Agent, or Firm* — Osha Liang LLP

(57) ABSTRACT

A drill bit includes a bit body comprising at its upper end a connection adapted to connect to a drill string and at its lower end a plurality of journals extending downwardly and radially outward from a longitudinal axis of the bit. A plurality of roller cones are rotatably mounted on the plurality of journals and at least three rows of cutting elements are disposed on each of the plurality of roller cones. The outermost row of the at least three rows of cutting elements has an extension height to diameter ratio greater than a mid row, and the mid row has an extension height to diameter ratio greater than an innermost row.

27 Claims, 27 Drawing Sheets

(56) References Cited

U.S. PATENT DOCUMENTS

| | | | | | |
|---|---|---|---|---|---|
| 1,195,208 | A | | 8/1916 | Griffin | |
| 1,327,913 | A | | 1/1920 | Hughes | |
| 1,348,419 | A | | 8/1920 | Hughes | |
| 1,374,867 | A | | 4/1921 | Wadsworth | |
| 1,402,684 | A | | 1/1922 | Thomas | |
| 1,747,908 | A | | 2/1930 | Seifert | |
| 1,812,475 | A | * | 6/1931 | Gildersleeve et al. | 175/347 |
| 1,850,358 | A | | 3/1932 | Scott | |
| 1,877,225 | A | | 9/1932 | Capeliuschnicoff | |
| 1,896,243 | A | * | 2/1933 | MacDonald | 175/367 |
| 2,121,202 | A | | 6/1938 | Killgore | |
| 2,174,587 | A | | 10/1939 | Love | |
| 2,380,112 | A | * | 7/1945 | Kinnear | 175/336 |
| RE23,416 | E | * | 10/1951 | Kinnear | 175/336 |
| 2,634,955 | A | | 4/1953 | Johnson | |
| 2,651,501 | A | * | 9/1953 | McMahon | 175/365 |
| 2,742,439 | A | | 4/1956 | Hallett | |
| 2,915,291 | A | * | 12/1959 | Gulfelt | 175/348 |
| 3,743,037 | A | | 7/1973 | Balakh et al. | |
| 3,923,109 | A | | 12/1975 | Williams, Jr. | |
| 3,945,447 | A | | 3/1976 | Peterson | |
| 4,127,043 | A | | 11/1978 | Evans | |
| 4,136,586 | A | | 1/1979 | Neilson et al. | |
| 4,145,094 | A | | 3/1979 | Vezirian | |
| 4,176,724 | A | | 12/1979 | Vezirian | |
| 4,187,743 | A | | 2/1980 | Thomas | |
| 4,204,437 | A | | 5/1980 | Espana | |
| 4,333,364 | A | | 6/1982 | Varel | |
| 4,350,060 | A | | 9/1982 | Vezirian | |
| 4,417,629 | A | | 11/1983 | Wallace | |
| 4,446,935 | A | | 5/1984 | Schumacher, Jr. | |
| 4,453,836 | A | * | 6/1984 | Klima | 384/94 |
| 4,549,614 | A | | 10/1985 | Kaalstad et al. | |
| 4,610,317 | A | | 9/1986 | England et al. | |
| 4,641,976 | A | * | 2/1987 | Kar | 384/95 |
| 4,694,551 | A | | 9/1987 | Mathews | |
| 4,751,972 | A | | 6/1988 | Jones et al. | |
| 4,763,736 | A | * | 8/1988 | Varel, Sr. | 175/341 |
| 4,765,205 | A | | 8/1988 | Higdon | |
| 4,796,713 | A | | 1/1989 | Bechem et al. | |
| 4,819,517 | A | | 4/1989 | Vezirian | |
| 4,832,143 | A | | 5/1989 | Kaalstad et al. | |
| 4,874,047 | A | | 10/1989 | Hixon | |
| 4,924,954 | A | | 5/1990 | Mead | |
| 4,953,641 | A | | 9/1990 | Pessier | |
| 5,027,911 | A | * | 7/1991 | Dysart | 175/57 |
| 5,064,007 | A | | 11/1991 | Kaalstad | |
| 5,147,000 | A | | 9/1992 | Kaalstad | |
| 5,189,932 | A | | 3/1993 | Palmo et al. | |
| 5,201,795 | A | | 4/1993 | Howard et al. | |
| 5,358,061 | A | | 10/1994 | Van Nguyen | |
| 5,441,120 | A | * | 8/1995 | Dysart | 175/228 |
| 5,452,770 | A | | 9/1995 | Millsapps, Jr. | |
| 5,505,273 | A | | 4/1996 | Azar et al. | |
| 5,524,510 | A | | 6/1996 | Davies et al. | |
| 5,586,612 | A | | 12/1996 | Isbell et al. | |
| 5,592,996 | A | | 1/1997 | Keith et al. | |
| 5,598,895 | A | | 2/1997 | Anderson et al. | |
| 5,606,895 | A | | 3/1997 | Huffstutler | |
| 5,695,018 | A | | 12/1997 | Pessier et al. | |
| 5,695,019 | A | | 12/1997 | Shamburger, Jr. | |
| 5,839,525 | A | | 11/1998 | Hoffmaster et al. | |
| 5,944,125 | A | * | 8/1999 | Byrd | 175/371 |
| 5,975,223 | A | | 11/1999 | Karlsson | |
| 6,033,117 | A | * | 3/2000 | Cariveau et al. | 384/94 |
| 6,254,275 | B1 | * | 7/2001 | Slaughter et al. | 384/92 |
| 6,321,858 | B1 | | 11/2001 | Wentworth et al. | |
| 6,345,673 | B1 | | 2/2002 | Siracki | |
| 6,439,326 | B1 | | 8/2002 | Huang et al. | |
| 6,450,271 | B1 | | 9/2002 | Tibbitts et al. | |
| 6,516,293 | B1 | | 2/2003 | Huang et al. | |
| 6,561,292 | B1 | | 5/2003 | Portwood | |
| 6,763,902 | B2 | | 7/2004 | Larsen et al. | |
| 6,779,613 | B2 | | 8/2004 | Dykstra et al. | |
| 6,810,971 | B1 | | 11/2004 | Sved | |
| 6,827,159 | B2 | | 12/2004 | Sved | |
| 6,935,443 | B2 | | 8/2005 | Ehler et al. | |
| 7,195,085 | B2 | | 3/2007 | Pia | |
| 7,341,119 | B2 | | 3/2008 | Singh et al. | |
| 7,464,773 | B2 | | 12/2008 | Rives | |
| 7,549,490 | B2 | | 6/2009 | McDonough et al. | |
| 8,056,651 | B2 | * | 11/2011 | Turner et al. | 175/381 |
| 8,141,664 | B2 | * | 3/2012 | Zahradnik et al. | 175/336 |
| 2001/0054514 | A1 | | 12/2001 | Sullivan et al. | |
| 2002/0000336 | A1 | | 1/2002 | Claesson et al. | |
| 2002/0029909 | A1 | | 3/2002 | Griffo et al. | |
| 2006/0054361 | A1 | * | 3/2006 | Boudrare et al. | 175/331 |
| 2007/0062736 | A1 | | 3/2007 | Cariveau et al. | |
| 2007/0131457 | A1 | * | 6/2007 | McDonough et al. | 175/374 |
| 2008/0011519 | A1 | | 1/2008 | Smith et al. | |
| 2009/0057030 | A1 | | 3/2009 | Didericksen et al. | |
| 2009/0272582 | A1 | | 11/2009 | McCormick et al. | |
| 2010/0163313 | A1 | | 7/2010 | Lin et al. | |
| 2010/0224417 | A1 | * | 9/2010 | Zahradnik et al. | 175/336 |
| 2010/0270085 | A1 | * | 10/2010 | Turner et al. | 175/381 |
| 2011/0024197 | A1 | * | 2/2011 | Centala et al. | 175/353 |
| 2011/0162893 | A1 | * | 7/2011 | Zhang | 175/428 |
| 2012/0031671 | A1 | | 2/2012 | Propes | |
| 2012/0080230 | A1 | * | 4/2012 | Flores et al. | 175/57 |

FOREIGN PATENT DOCUMENTS

| | | | |
|---|---|---|---|
| GB | 2203470 | A | 10/1988 |
| GB | 2384503 | A | 7/2003 |
| WO | 2008124572 | A1 | 10/2008 |

OTHER PUBLICATIONS

International Search Report with Written Opinion issued in International Application No. PCT/US2010/043604 dated Mar. 3, 2011 (8 pages).

"The Disc Bit-A Tood for Hard-Rock Drilling", J.C.R. Placido and J.E. Friant; Dec. 2004 SPE Drilling & Completion; pp. 205-211.

International Search Report with Written Opinion issued in related International Application No. PCT/US2011/020091 dated Jun. 23, 2011 (8 pages).

Office Action issued in related U.S. Appl. No. 12/844,589; Dated Jan. 4, 2013 (23 pages).

* cited by examiner

FIG. 1 --Prior Art--

HIGH SHEAR ROLLER CONE DRILL BITS

CROSS-REFERENCE TO RELATED APPLICATIONS

This application claims priority to U.S. Patent Application Nos. 61/230,497, filed on Jul. 31, 2009, and 61/330,532, filed on May 3, 2010, both of which are herein incorporated by reference in their entirety.

BACKGROUND OF INVENTION

1. Field of the Invention

Embodiments disclosed herein relate generally to drill bits. In particular, embodiments disclosed herein relate to roller cone drill bits having outwardly facing roller cones.

2. Background Art

Historically, there have been two main types of drill bits used drilling earth formations, drag bits and roller cone bits. The term "drag bits" refers to those rotary drill bits with no moving elements. Drag bits include those having cutters attached to the bit body, which predominantly cut the formation by a shearing action. Roller cone bits include one or more roller cones rotatably mounted to the bit body. These roller cones have a plurality of cutting elements attached thereto that crush, gouge, and scrape rock at the bottom of a hole being drilled.

Roller cone drill bits typically include a main body with a threaded pin formed on the upper end of the main body for connecting to a drill string, and one or more legs extending from the lower end of the main body. Referring now FIGS. 1 and 2, a conventional roller cone drill bit, generally designated as 10, has a bit body 12 forming an upper pin end 14 and a cutter end of roller cones 16 that are supported by legs 13 extending from body 12. The threaded pin end 14 is adapted for assembly onto a drill string (not shown) for drilling oil wells or the like. Each of the legs 13 terminate in a shirttail portion 22.

Each of the roller cones 16 typically have a plurality of cutting elements 17 thereon for cutting earth formation as the drill bit 10 is rotated about the longitudinal axis L. While cutting elements 17 are shown in FIGS. 1 and 2 pressed within holes formed in the surfaces of the cones, other types of bits have hardfaced steel teeth milled on the outside of the cone 16 instead of carbide inserts. Nozzles 20 in the bit body 12 introduce drilling mud into the space around the roller cones 16 for cooling and carrying away formation chips drilled by the drill bit.

Each leg 13 includes a journal 24 extending downwardly and radially inward towards a center line of the bit body 12. The journal 24 includes a cylindrical bearing surface 25 which may have a flush hardmetal deposit 62 on a lower potion of the journal 24. The cavity in the cone 16 contains a cylindrical bearing surface 26. A floating bearing 45 may be disposed between the cone and the journal. Alternatively, the cone may include a bearing deposit in a groove in the cone (not shown separately). The floating bearing 45 engages the hardmetal deposit 62 on the leg and provides the main bearing surface for the cone on the bit body. The end surface 33 of the journal 24 carries the principal thrust loads of the cone 16 on the journal 24. Other types of bits, particularly for higher rotational speed applications, may have roller bearings instead of the exemplary journal bearings illustrated herein.

A plurality of bearing balls 28 are fitted into complementary ball races 29, 32 in the cone 16 and on the journal 24. These balls 28 are inserted through a ball passage 42, which extends through the journal 24 between the bearing races and the exterior of the drill bit. A cone 16 is first fitted on the journal 24, and then the bearing balls 28 are inserted through the ball passage 42. The balls 28 carry any thrust loads tending to remove the cone 16 from the journal 24 and thereby retain the cone 16 on the journal 24. The balls 28 are retained in the races by a ball retainer 64 inserted through the ball passage 42 after the balls are in place and welded therein.

Contained within bit body 12 is a grease reservoir system generally designated as 18. Lubricant passages 21 and 42 are provided from the reservoir to bearing surfaces 25, 26 formed between a journal bearing 24 and each of the cones 16. Drilling fluid is directed within the hollow pin end 14 of the bit 10 to an interior plenum chamber 11 formed by the bit body 12. The fluid is then directed out of the bit through the one or more nozzles 20.

The bearing surfaces between the journal 24 and cone 16 are lubricated by a lubricant or grease composition. The interior of the drill bit is evacuated, and lubricant or grease is introduced through a fill passage 46. The lubricant or grease thus fills the regions adjacent the bearing surfaces plus various passages and a grease reservoir. The grease reservoir comprises a chamber 19 in the bit body 10, which is connected to the ball passage 42 by a lubricant passage 21. Lubricant or grease also fills the portion of the ball passage 42 adjacent the ball retainer. Lubricant or grease is retained in the bearing structure by a resilient seal 50 between the cone 16 and journal 24.

Lubricant contained within chamber 19 of the reservoir is directed through lube passage 21 formed within leg 13. A smaller concentric spindle or pilot bearing 31 extends from end 33 of the journal bearing 24 and is retained within a complimentary bearing formed within the cone. A seal generally designated as 50 is positioned within a seal gland formed between the journal 24 and the cone 16.

While roller cone bits have had a long presence in the market due to their overall durability and cutting ability (particularly when compared to previous bit designs, including disc bits), fixed cutter bits gained significant growths, particularly in view of the rates of penetration achievable and repairability. Accordingly, there exists a continuing need for developments in roller cone bits that may at least provide for increased rates of penetration.

SUMMARY OF INVENTION

In one aspect, embodiments disclosed herein relate to a drill bit that may include a bit body, comprising: at its upper end, a connection adapted to connect to a drill string and at its lower end, a plurality of journals extending downwardly and radially outward from a longitudinal axis of the bit; a plurality of roller cones rotatably mounted on the plurality of journals; and at least three rows of cutting elements disposed on each of the plurality of roller cones, wherein an outermost row has an extension height to diameter ratio greater than a mid row, and the mid row has an extension height to diameter ratio greater than an innermost row.

In another aspect, embodiments disclosed herein relate to a drill bit that may include a bit body, comprising: at its upper end, a connection adapted to connect to a drill string; and at its lower end, a plurality of journals extending downwardly and radially outward from a longitudinal axis of the bit; a plurality of roller cones rotatably mounted on the plurality of journals, wherein at least one of the plurality of roller cones has a nose height to outer cone diameter ratio of greater than 0.5; and a plurality of cutting elements disposed on the plurality of roller cones.

In yet another aspect, embodiments disclosed herein relate to a drill bit that may include a bit body, comprising: at its upper end, a connection adapted to connect to a drill string and at its lower end, a plurality of journals extending downwardly and radially outward from a longitudinal axis of the bit; a plurality of roller cones rotatably mounted on the plurality of journals; a plurality of cutting elements disposed on the plurality of roller cones; and a plurality of nozzles inserted into nozzle bores formed on an outer circumference of the bit body.

In yet another aspect, embodiments disclosed herein relate to a drill bit that may include a bit body, comprising: at its upper end, a connection adapted to connect to a drill string and at its lower end, a plurality of journals extending downwardly and radially outward from a longitudinal axis of the bit; a plurality of roller cones rotatably mounted on the plurality of journals; and a plurality of cutting elements disposed on the plurality of roller cones.

Other aspects and advantages of the invention will be apparent from the following description and the appended claims.

DETAILED DESCRIPTION

Figure 1:
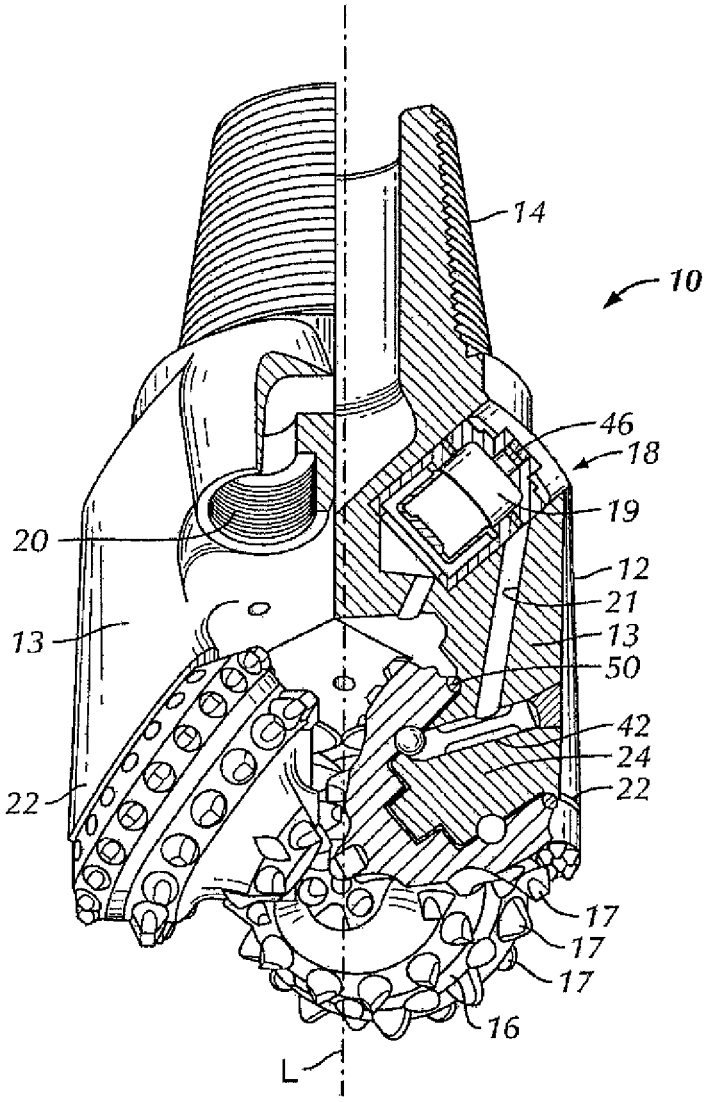
FIG. 1 is a semi-schematic perspective of a conventional three cone roller cone bit.
Figure 2:
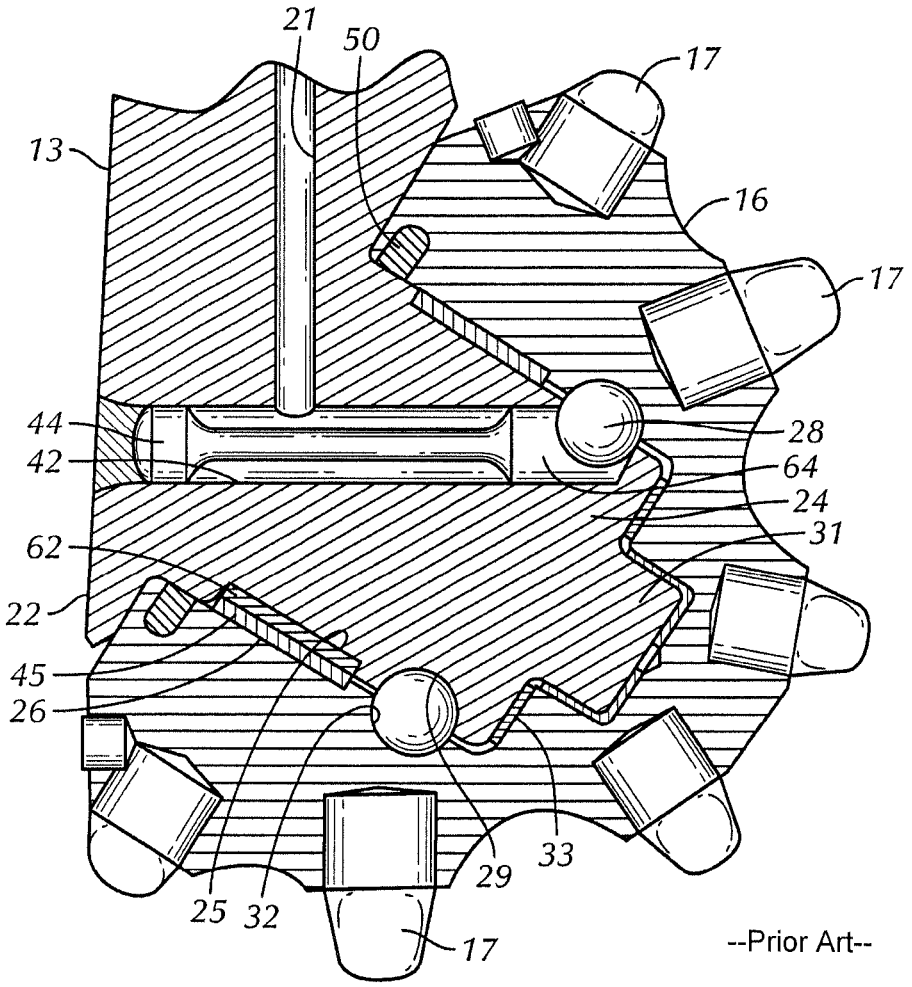
FIG. 2 is a partial cross-section of the drill bit in FIG. 1.

In one aspect, embodiments disclosed herein relate to roller cone drill bits having outwardly facing roller cones. Outwardly facing refers to cones attached to a drill bit where the noses of the plurality of cones are angled radially outward away from the centerline of the bit. Use of such cone configuration may allow for a bit having a cutting action unique for roller cone bits, replaceable cones, and greater cutting efficiency with increased shearing action, as compared to conventional roller cone bits, such as those shown in FIGS. 1 and 2. Accompanying the outwardly directed journals (and cones) are numerous other differences in the bit structure that are unique, as compared to a prior bit structures.

Figure 3:
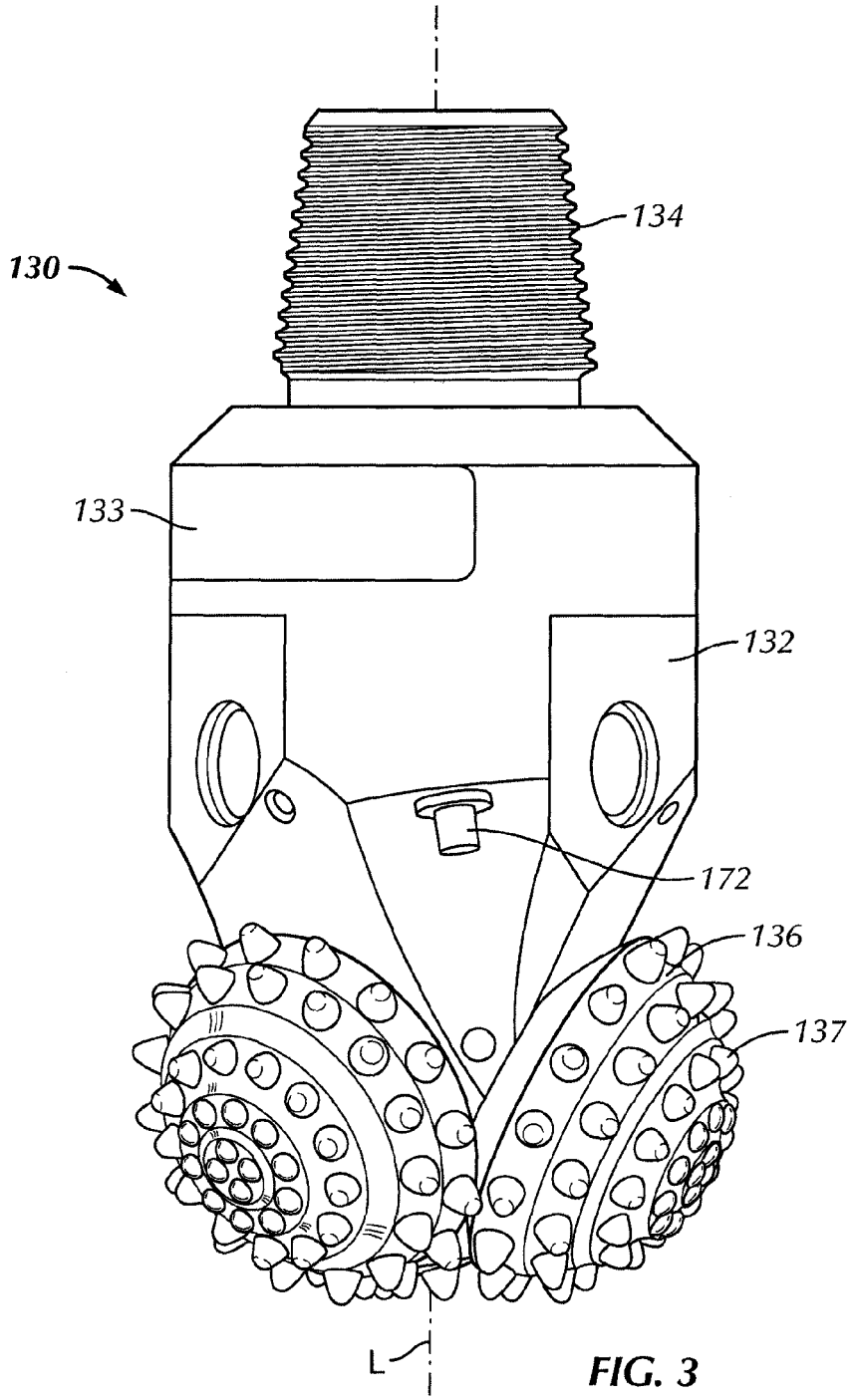
FIG. 3 is a side view of a roller cone bit according to one embodiment of the present disclosure.
Figure 4:
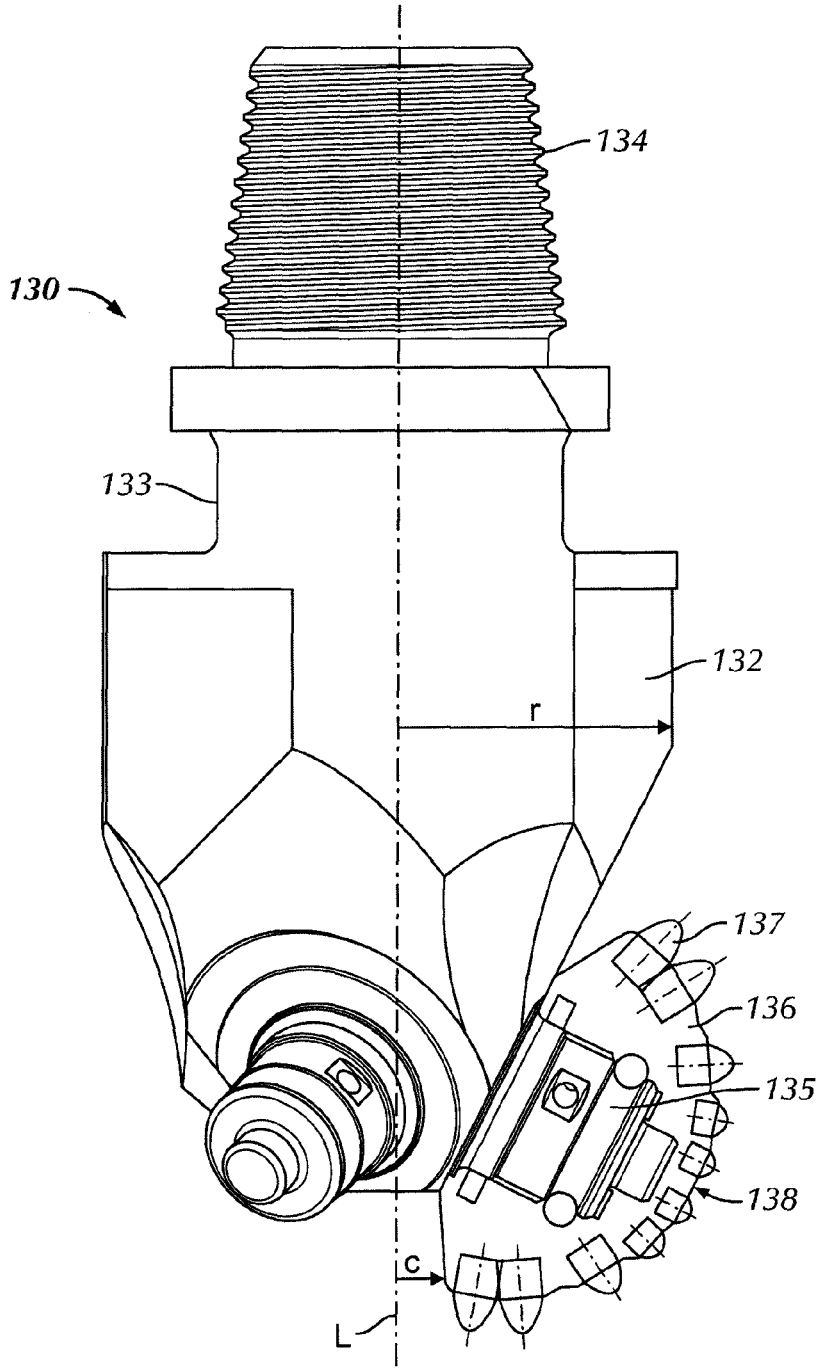
FIG. 4 is a semi-schematic perspective of a roller cone bit according to one embodiment of the present disclosure.

Referring to FIGS. 3 and 4, two views of a roller cone drill bit according to one embodiment of the present disclosure are shown. As shown in FIG. 3, a roller cone drill bit 130 includes a bit body 132 having at its upper end, a threaded pin end 134 for coupling bit 130 to a drill string (not shown). At the lower end of bit 130 is the cutting end of bit 130. In particular, bit body 132 terminates at its lower end into a plurality of journals 135 (journals are integral with the rest of bit body). Each journal 135 extends downward and radially outward, away from longitudinal axis L of bit 130. On each journal 135, a roller cone 136 having a frustoconical shape is rotatably mounted. Each roller cone 136 has disposed thereon a plurality of rows of cutting elements 137: at least three rows of cutting elements 137 in some embodiments or at least four or five rows of cutting elements in other embodiments.

Further, according to some embodiments, bit body 132 (excluding journals 135) may be generally shaped to have its lowest diameter at an axial location below the greatest diameter, whereas in a conventional roller cone bit, the greatest diameter of the bit body (12 in FIG. 1) is at the shirttail (22 in FIG. 1), which is the lowest axial position of the bit body (also excluding journals).

Beneath threaded pin end 134, bit body 132 may optionally include bit breaker slots 133. Bit breaker slots 133 may be flat-bottomed recesses cut into the generally cylindrical outer surface of the bit body 132. Slots 133 facilitate bit breaker (not shown) engagement with the drill bit during the attachment or detachment of the threaded pin 134 into an internally threaded portion of a lower end of a drill string.

Figure 5:
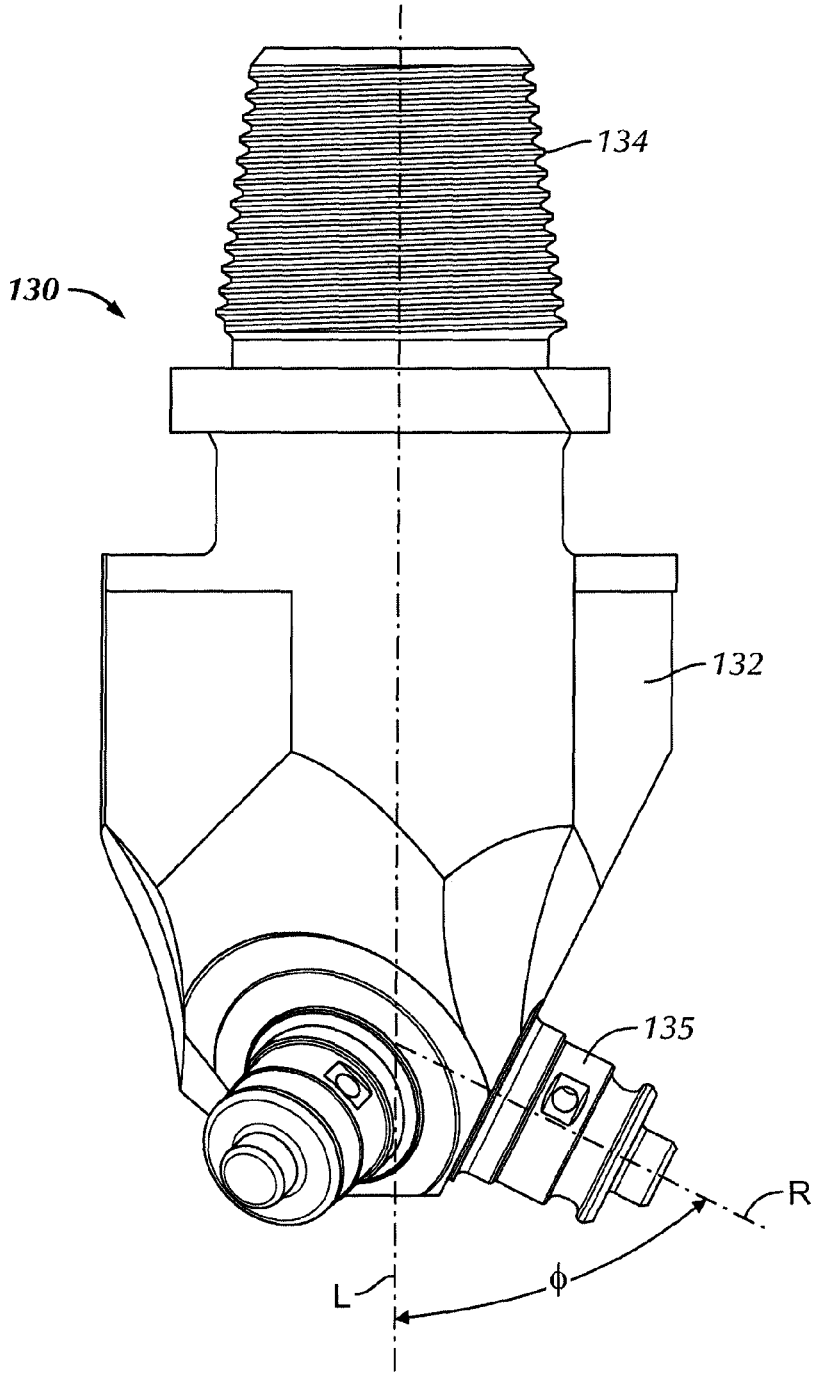
FIG. 5 is a side view of a roller cone bit body according to one embodiment of the present disclosure.

As shown in FIG. 5, journal 135 extends downward and radially outward from longitudinal axis L of bit 130 such an acute angle p is formed between journal axis R (axis about which cone (not shown in FIG. 5) rotates) and longitudinal axis L about which bit 130 rotates. According to various embodiments of the present disclosure, ϕ may broadly range from 15 to 70 degrees. However, in particular embodiments, ϕ may range from any lower limit of 40, 45, 50, 60 or 65 degrees to any upper limit of 60, 65, or 70 degrees. In a more particular embodiment, ϕ may range from 50 to 60 degrees. One skilled in the art should appreciate that the journal angle (as that term is used in the art) is related to ϕ. In particular, the journal angle is defined in the art as the angle formed by a line perpendicular to the axis of a bit and the axis of the journal and thus may be equal to 90−ϕ. Selection of ϕ (and journal angle) may be based factors such as the relative cone size (and desired cone size), the type of cutting action desired (shearing, scraping, rolling), formation type, the number of cutting element desired to contact the bottom hole at one time, desired cone rotation speed, desired shear/indention ratio, desired core size, etc. For example, in a soft formation (where greater shearing is desired), it may be desirable for y to range from 60 to 70 degrees whereas in a hard formation (where greater rolling is desired), it may be desirable for ϕ to range from 40 to 60 degrees.

Use of such angle ϕ (and related journal angle) may contribute (in part) to the largest part of the cone 136 diameter being the closest portion of the cone 136 to the centerline or longitudinal axis L of bit 130. Further, in addition to this, in accordance to embodiments of the present disclosure, as shown in FIG. 4, the distance from the longitudinal axis L to the greatest cone diameter may be represented as c, and the ratio of c to bit radius r may range from 0 to 0.25, which may be reflective of the core size of the bit. However, in particular embodiments, the ratio of c to bit radius r may range from any lower limit of 0, 0.05, 0.1, 0.15, and 0.2 to any upper limit of 0.05, 0.1, 0.15, 0.2, and 0.25. In addition to ϕ/journal angle, this core size may also depend on the relative cone size, radial journal location, etc.

While FIG. 5 shows the angle ϕ for a single journal, one skilled in the art should appreciate after learning the teachings related to the present invention contained in this invention, that each journal may form an acute angle ϕ1, ϕ2, etc. with respect to the longitudinal axis of the bit, which may be the same or different from the other journals. For example, as shown in FIG. 6, another embodiment may allow for differing acute angles ϕ1, ϕ2 formed between journal axes R1, R2 and longitudinal axis L for journal 135*a* and journal 135*b*.

Figure 6:
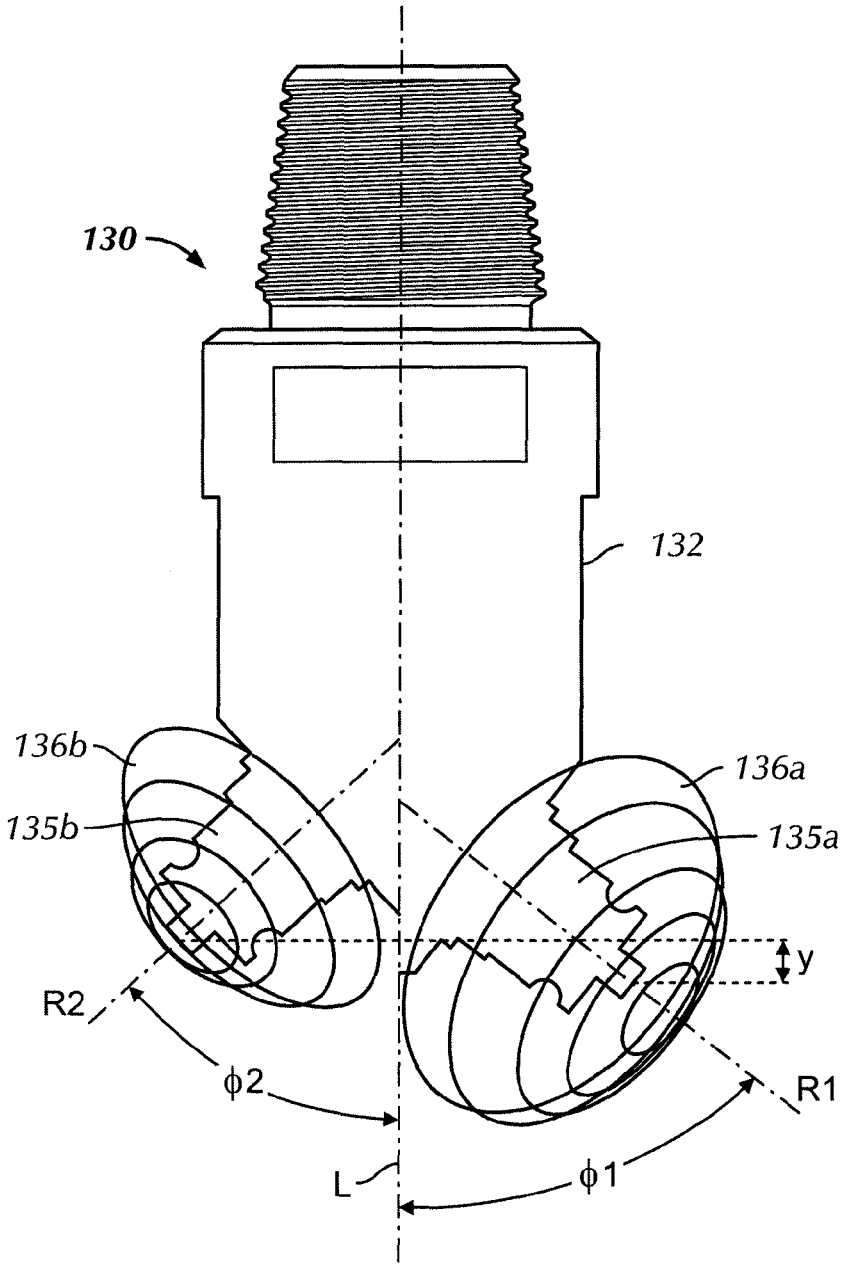
FIG. 6 is a side view of a roller cone bit body according to another embodiment of the present disclosure.

In addition to different axial placements between journals 135*a* and 135*b*, as also shown in FIG. 6, journals 135*a* and 135*b* may extend from different axial locations of bit body 132. For example, journal 135*a* may be axially distanced or separated from journal 135*b* on a bit. Such axial separation y may be measured from any two points on the journal, such as the nose of the journal, as shown in FIG. 6. Further, depending on such configurations (differing acute angles ϕ and/or axial separation y), it may also be desired to have different relative sizes of cones 136*a* and 136*b*. Cone sizes may differ with respect to one or more of a cone's outer radius, nose projection, radius of curvature, etc.

Figure 7:
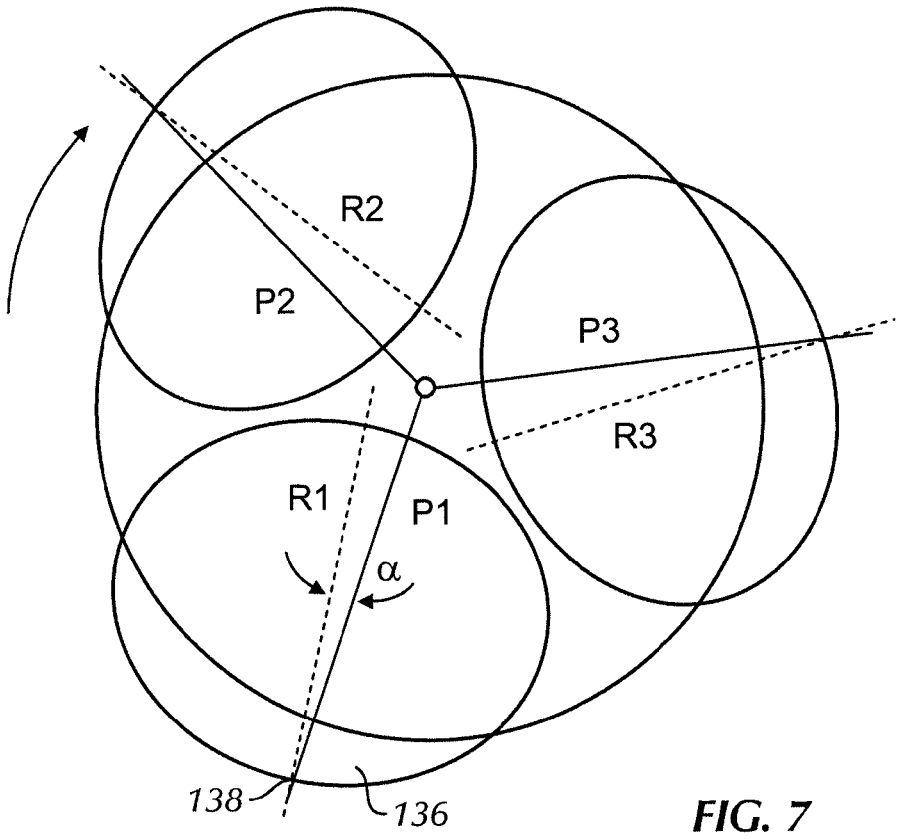
FIG. 7 is a schematic bottom view of a roller cone bit according to one embodiment of the present disclosure.

In some embodiments, the journals 135 (and cones 136) may be provided with an offset, as shown in FIG. 7. Journal/cone offset can be determined by viewing the drill bit from the bottom on a horizontal plane that is perpendicular to the center axis L. Offset, represented as α, is the angle between a journal axis R and a line P on the horizontal plane that intersects the center axis L and the nose 138 of cone 136. A positive offset is defined by an angle opening with the direction of rotation of the drill bit. A negative offset is defined by an angle against the direction of rotation of the drill bit. As shown in FIG. 7, a positive offset is provided for each cone 136; however, in other embodiments, any combination of positive and/or negative offsets or only negative offsets may be used. In a particular embodiment, any number of cones (one or more or all) may be provided with zero or no offset, different offset directions and/or different magnitudes of offset.

For example, in embodiments where one cone is larger than the others, it may be desirable for that cone to at least have a different magnitude of offset.

Additionally, cone offset may be used alone or in combination with varying cone separation angles. Specifically, when a journal axis offset or skewed with respect to the centerline of the bit, the cone separation angle may be determined by the angle formed between two lines P (e.g., P1 and P2) on the horizontal plane that intersect the center axis L and the nose 138 of cone 136.

The bit 130 shown in FIG. 7 has three cones 136, each having a cone separation angle of 120° (angle between pairs of neighboring journal axis R1, R2, and R3 (or P1, P2, or P3) when projected upon a horizontal plane that is perpendicular to the center axis L of the drill bit). However, in other embodiments the angles between neighboring journals/cones need not be uniform. Further, one skilled in the art should appreciate that the present disclosure is not limited to bits having three cones, but equally applies to bits having any number of multiple cones, including for example, two or four cones. one skilled in the art should appreciate after learning the teachings related to the present invention contained in this invention that the angle between cones may depend, in some part, on the number of cones on a bit, but may also depend on other desired cone separation angle variances.

Figure 8:
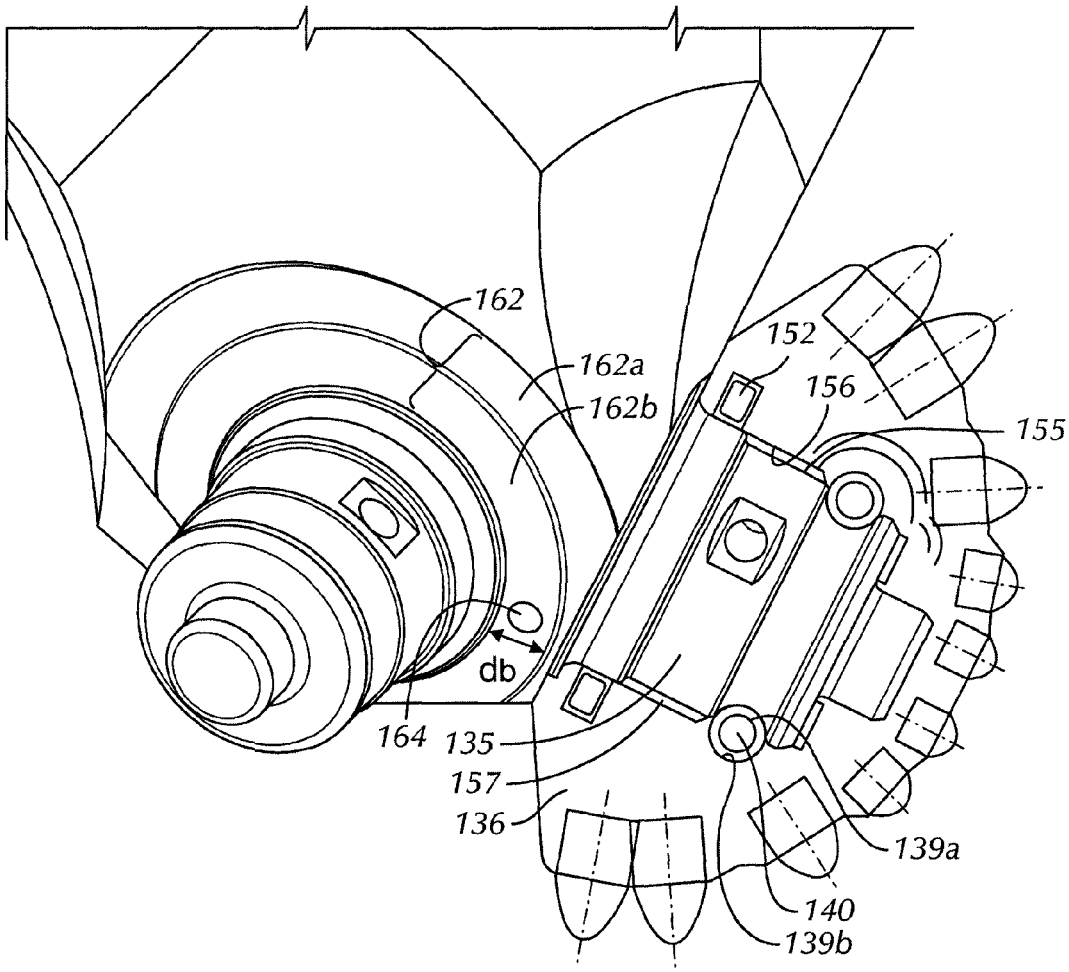
FIG. 8 is a schematic of a roller cone retained on a journal according to one embodiment of the present disclosure.
Figure 9:
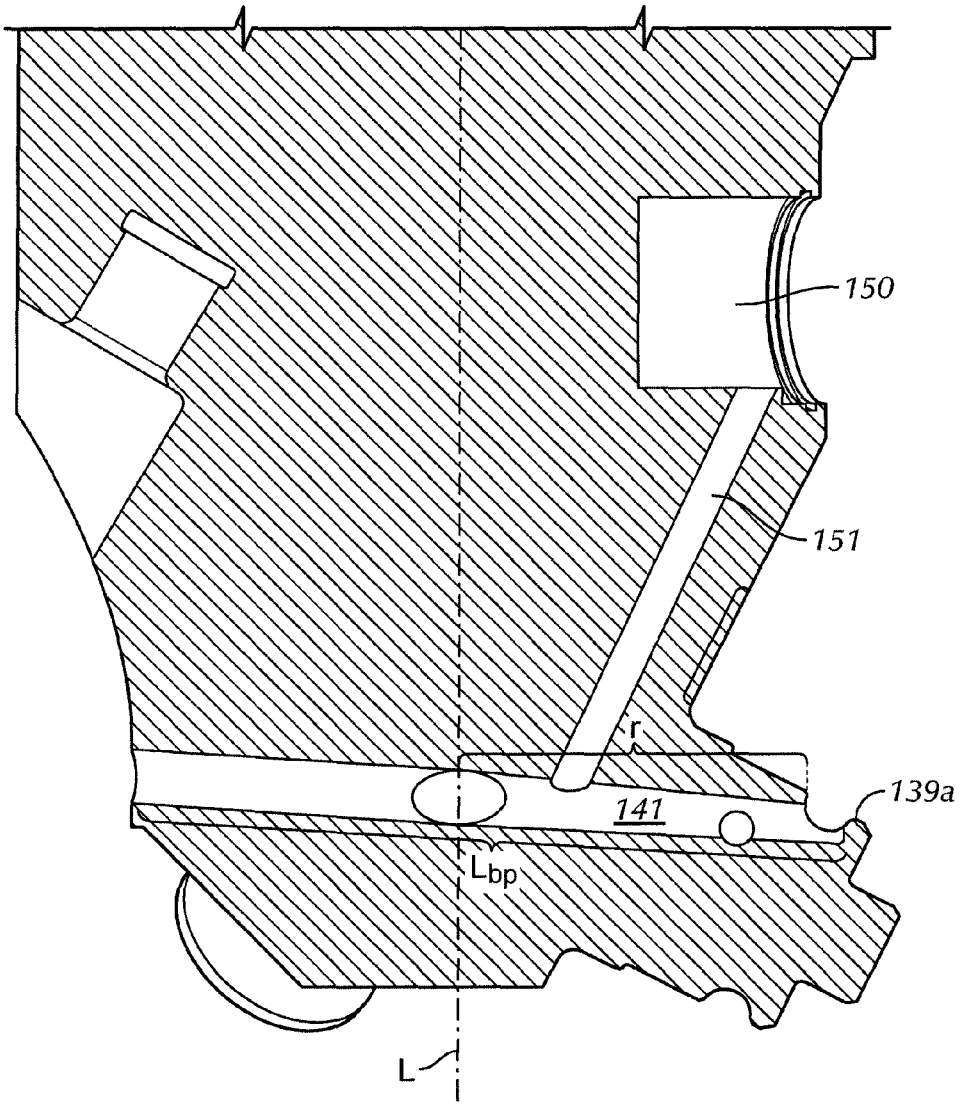
FIG. 9 shows a partial cross-section view of a drill bit according to one embodiment of the present disclosure.
Figure 10:
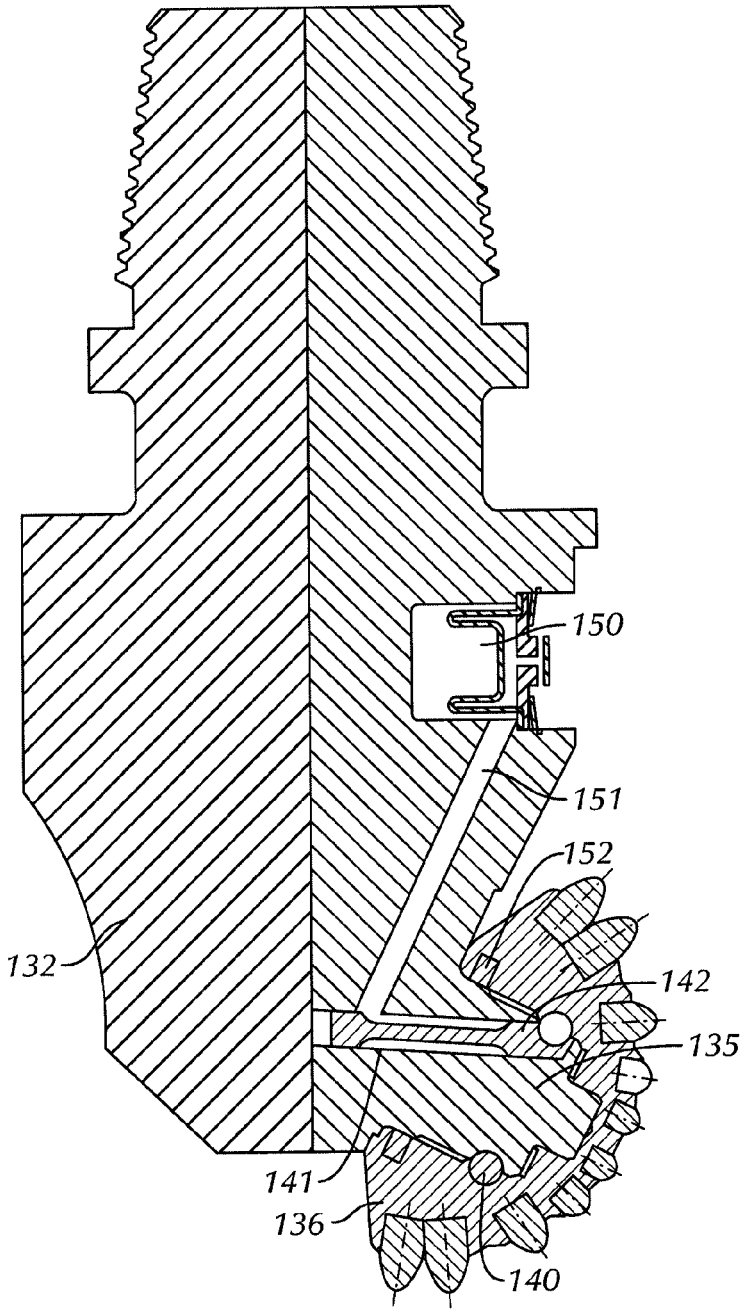
FIG. 10 shows a cross-section view of a drill bit according to one embodiment of the present disclosure.

Additionally in accordance with various embodiments of the present disclosure, as shown in FIG. 8-10 together, roller cone 136 may be retained on journal 135 through a unique ball bearing retainer system. Specifically, a plurality of bearing balls 140 are fitted into complementary ball races 139*a*, 139*b* in the journal 135 and cone 136, respectively, to retain cone 136 on journal 135. These balls 140 are inserted through a ball passage 141, which extends through the bit body 132 to journal 135 between the bearing races 139*a* and 139*b*. Specifically, ball passage 141 transverses bit body 132 a total length $L_{bp}$ that is greater than the length of the radius r from a centerline or longitudinal axis L of the bit to the opening in ball race 139*a*. A cone 136 is first fitted on the journal 135, and then the bearing balls 140 are inserted through ball passage 141 to fit in the space between ball races 139*a* and 139*b*. Balls 140 are retained in ball races 139*a* and 139*b* by ball retainer 142, which is inserted into passage 141 after balls 140, and then secured in place (such as by a plug welded in place). The balls 140 carry any thrust loads tending to remove the cone 136 from the journal 135 and thereby retain the cone 136 on the journal 135. In some embodiments, the ball passages 141 may intersect near the bit centerline; however, the intersection of the ball passages 141 may depend on bit size, cone number, etc. Additionally, it is also within the scope of the present disclosure that the ball passages 141 do not extend such a length as described above. For example, ball passages 141 may only extend approximately to a bit centerline. Such an embodiment may be used when manufacturing the bit from multiple pieces, such as described in U.S. Patent Application entitled "Manufacturing Methods for High Shear Roller Cone Bits"(Attorney Docket No. 05516/414001), filed concurrently herewith, which is assigned to the present assignee and herein incorporated by reference in its entirety.

Lubricant passages 151 are provided from grease reservoir 150 to bearing surfaces 155, 156 formed between journal 135 and each of the cones 136, respectively. Bearing surfaces 155 and 156 between the journal 135 and cone 136, respectively, are lubricated by a lubricant or grease composition. The lubricant or grease fills the regions adjacent the bearing surfaces 155 and 156 plus lubricant passages 151 (and a portion of ball passage 141) and a grease reservoir 150 located at the exterior of bit 130 above journal 135. Lubricant or grease is retained in the bearing structure by a resilient seal 152 within a seal gland formed between the cone 136 and journal 135. Grease reservoir 150 may be located at a height of the bit body 132 such that the lowermost end of grease reservoir 150 is at least 25 percent of the total bit body height and no more than 50 percent of the total bit body height. Further, in particular embodiments, grease reservoirs may be located in the bit body such that an axis of the grease reservoir does not intersect the bit centerline, but instead may be offset by at least 10 degrees, and from 15 to 20 degrees in other embodiments.

Figure 25:
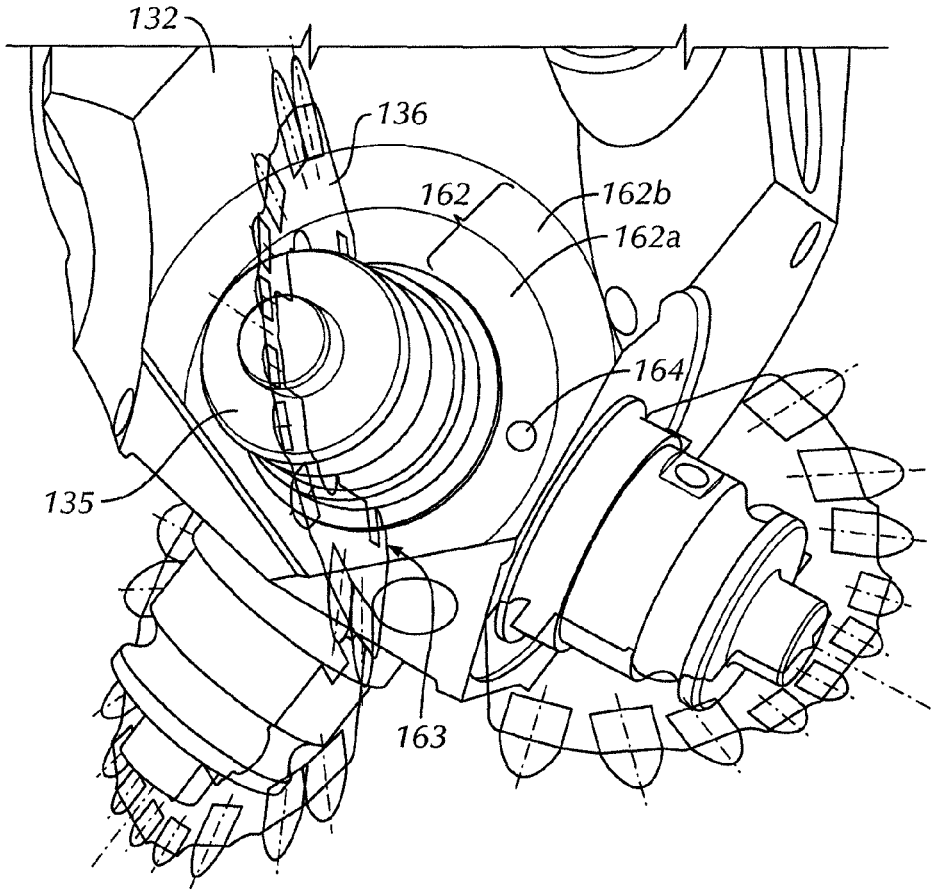
FIG. 25 is a perspective view of a lower end of a roller cone bit according to one embodiment of the present disclosure.
Figure 26A:
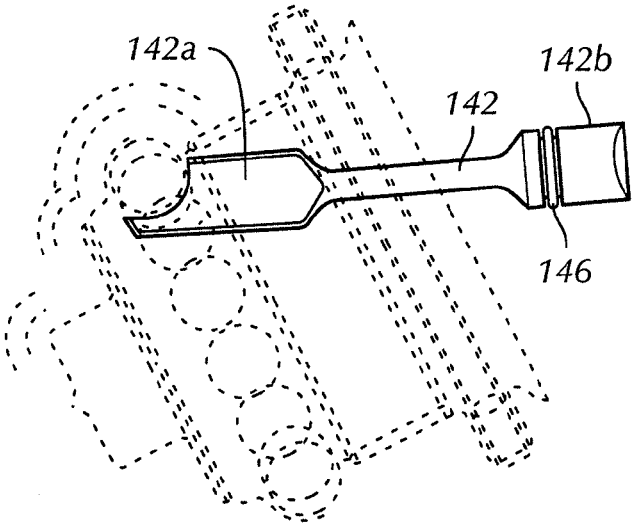
FIGS. 26A-B show embodiments for retaining cones on a roller cone bit in accordance with embodiments of the present disclosure.
Figure 26B:
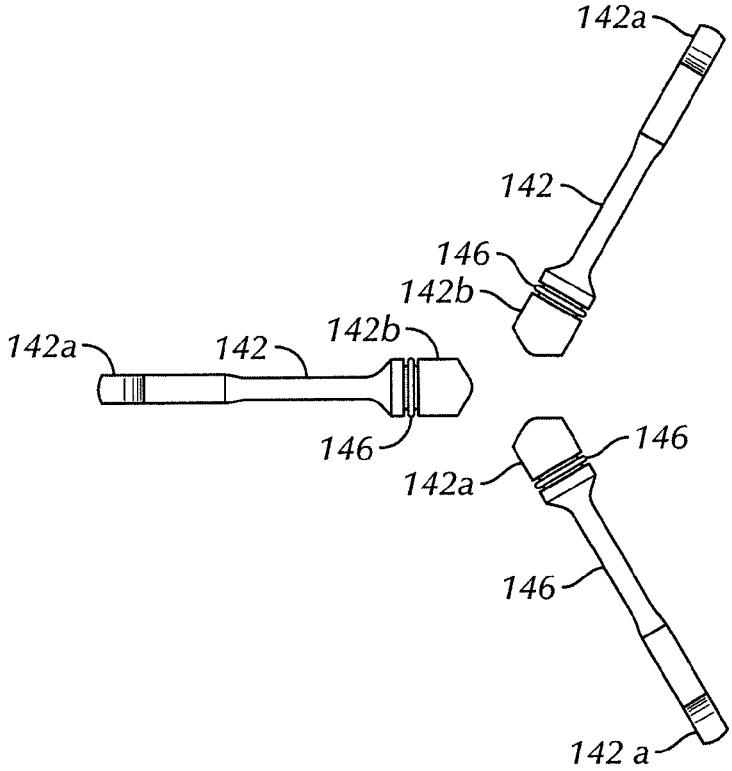
Figure 27A:
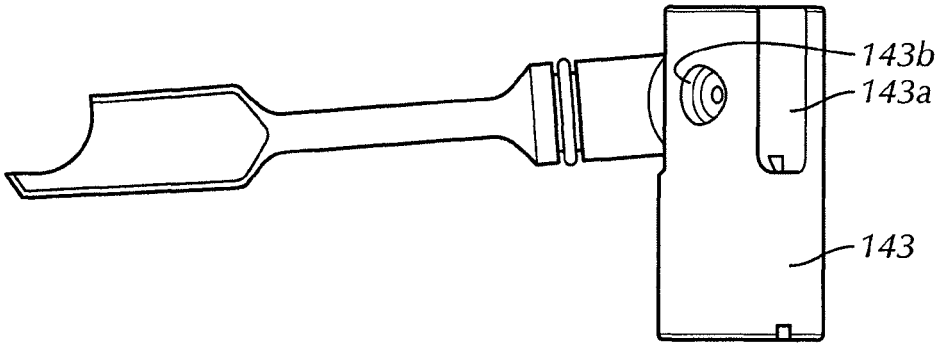
FIGS. 27A-B show embodiments for retaining cones on a roller cone bit in accordance with embodiments of the present disclosure.
Figure 27B:
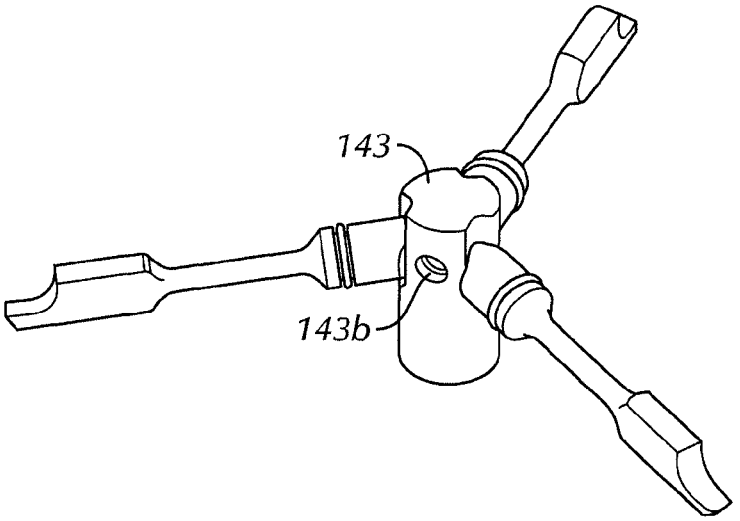
Figure 28A:
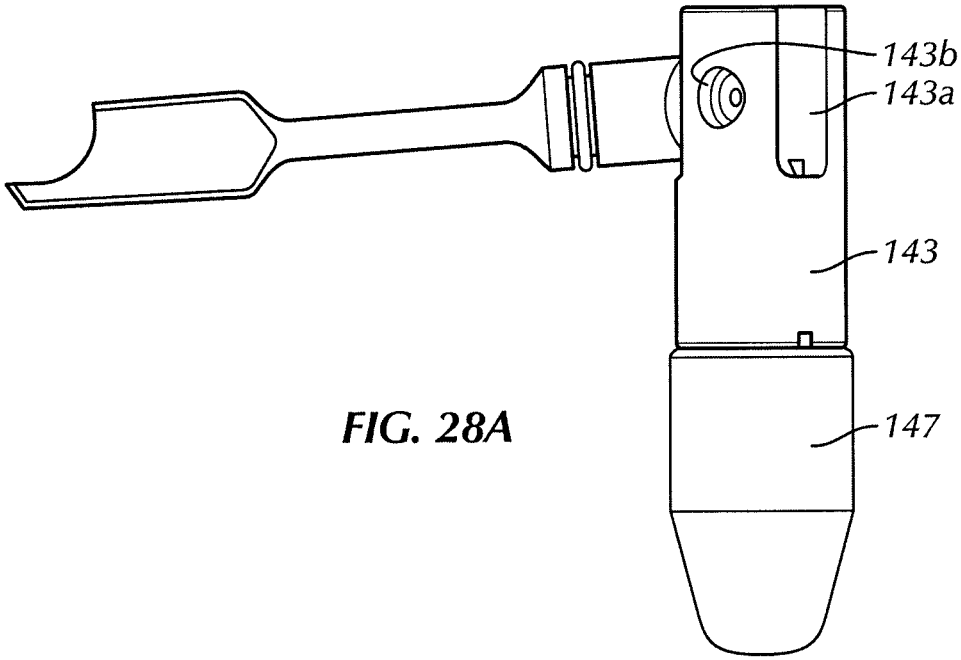
FIGS. 28A-B show embodiments for retaining cones on a roller cone bit in accordance with embodiments of the present disclosure.
Figure 28B:
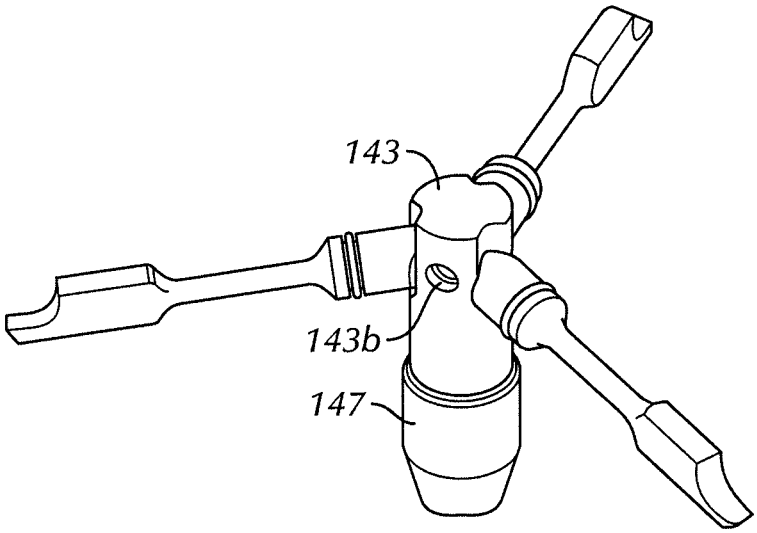
Figure 29A:
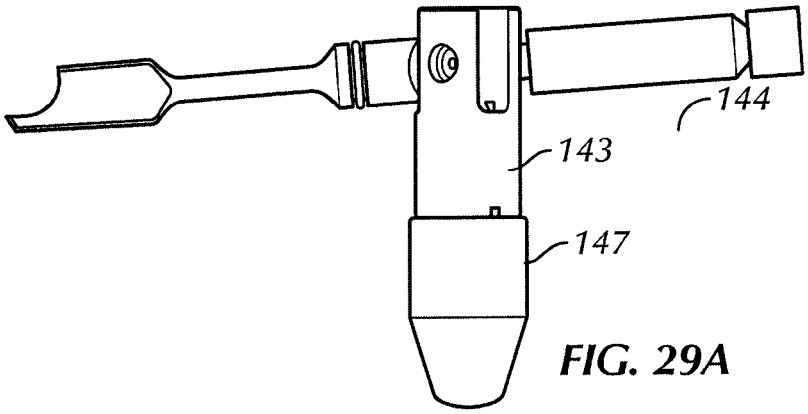
FIGS. 29A-C show embodiments for retaining cones on a roller cone bit in accordance with embodiments of the present disclosure.
Figure 29B:
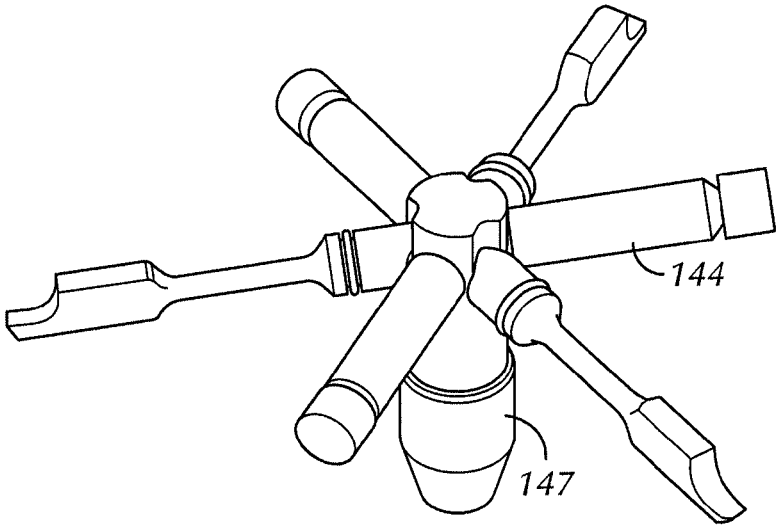
Figure 29C:
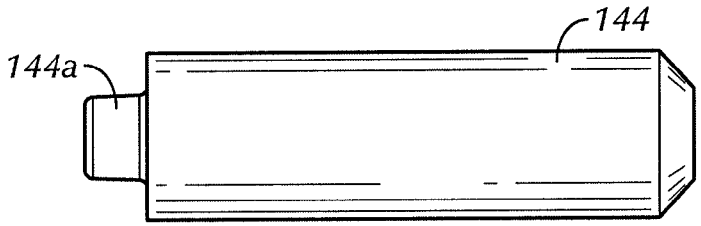

Referring to FIG. 8 and also shown in FIG. 25, the portion of the bit body adjacent journals 135 may be referred to as the backface area 162, due to its proximity to the cone backface 163. Backface area 162 may include a backface 162*a*, which may oppose a planar surface of the cone backface 163, and a shale groove region 162*b*, which may be a circumferential groove substantially surrounding the backface 162*a* and the journal 135. However, the groove (and backface) may not necessarily extend 360° around journal 135 due to the proximity of the journals to the bit centerline. Rather, due to the proximity of the journals to the bit centerline, the backface 162*a* and/or shale groove 162*b* of neighboring journals 135 may intersect in some embodiments, but not in other embodiments. Further, the proximity of neighboring journals 135 and backfaces 162*a* may be determined by considering the shortest distance between the seal gland of one journal 135 to the backface 162 of another journal 135 (shown in FIG. 8 as distance $d_b$), relative to the total bit diameter. For example, in various embodiments, this distance may be less than 18% of the total bit diameter, or less than 12% in other embodiments.

In some embodiments, a drill cuttings diverter means 164, such as an elastomeric shale burn plug, may be provided in the backface area 162 that is energized to force the plug into contact with the roller cone backface 163 to wipe clean the face proximate the seal gland to prevent packing and abrasion of the seal gland. The burn plug 164 may be located on the backface 162*a* at a location selected so that it may wipe the cone backface along the leading direction of the cone rotation. For example, as shown in FIG. 25, burn plug 164 is placed closer to the bottom of bit body on the journal side that is appropriate for a counter clock-wise rotation of cone 136.

Figure 11A:
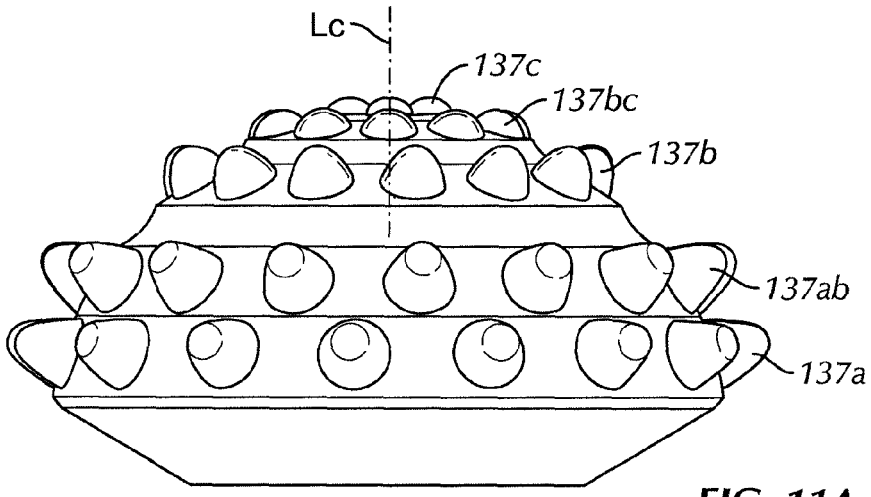
FIGS. 11A-B show a side and cross-section view of a roller cone according to one embodiment of the present disclosure.
Figure 11B:
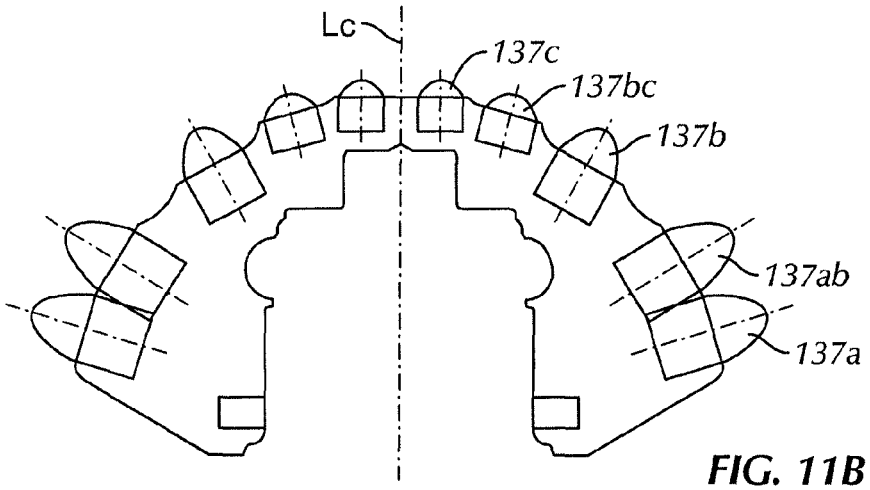
Figure 11C:
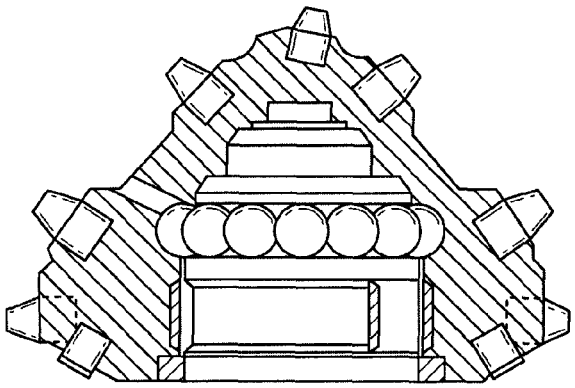
FIG. 11C (Prior Art)
FIG. 11C shows a cross-section view of a conventional roller cone.

Further, cutting structures may also be varied, one example of which is shown in FIG. 11A-B (and may be compared to a conventional roller cone and its cutting structure, shown in FIG. 11C). Various embodiments of the present disclosure may include at least three rows of cutting elements 137, including an outermost row 137*a*, an innermost row 137*c*, and at least one mid row 137*b*. As used herein, the rows of cutting elements may be identified by their radial distance to the cone axis $L_C$. For example, the innermost row 137*c* is the row having the shortest radial distance to the cone axis $L_C$; the outermost row 137*a* is the row having the greatest radial distance to the cone axis $L_C$; and a mid row 137*b* is a row having a radial distance to the cone axis $L_C$ between that of or equal to the innermost row 137*c* and outermost row 137*a*. Each of the classes of rows may have cutting element geometries specifically tailored to the placement on the cone (and radial distance from the cone axis). For example, outermost row 137*a* may have the greatest extension height, innermost row 137*c* may have the lowest extension height, and mid row 137*b* may have an extension height therebetween. As used herein, extension height refers to the height of the insert from the surface land of the cone surrounding the insert to the apex of the insert. Further, in a particular embodiment, the cutting elements 137 in order of closeness to the cone axis (i.e., by increasing radial distance) may generally have a trend of increasing extension height. However, this trend may include at least one row having the same extension height as the preceding neighboring row of cutting elements. Further, as shown in FIG. 11A-B, there may also be at least one other mid row, 137*ab* and/or 137*bc*, neighboring and with extension heights similar to outermost row 137*a* and innermost row 137*c*, respectively, such that the mid row 137*ab* and/or mid row 137*bc* would be considered to be outermost row 137*a* and innermost row 137*c* for purposes of extension height. However, it is also within the scope of the present disclosure that the rows neighboring outermost row 137*a* and innermost row 137*c* do not have extension heights similar to their respective neighboring innermost or outermost row and would thus be considered to be equivalent to mid row 137*b* with respect to the extension height ranges described herein. In other embodiments, the extension height of mid row 137*ab* and/or 137*bc* may be different than rows 137*a* and 137*c*, respectively. Further, according to the present disclosure, at least one of the two most radially inner rows, row 137*c* and 137*bc* in the embodiment shown in FIG. 11A-B, may cut the corner of the borehole.

One way of determining the relative extensions of cutting elements 137 is by accounting for the extension height relative to the cutting element diameter. In a particular embodiment, outermost row of cutting elements 137*a* may have an extension height:cutting element diameter ratio of at least 0.675 (and at least 0.70 in a particular embodiment), whereas at least one mid row 137*b* may have an extension height: diameter ratio ranging between 0.52 and 0.70, and innermost row 137*c* may have an extension height:diameter ratio of less than 0.48. In a particular embodiment, the extensions may be selected based on whether it is desired for the collective cutting profile to have a substantially constant radius of curvature along the profile or not. In a particular embodiment, the cutting profile may have a substantially constant radius of curvature.

For example, the radius from the cutting tip of the outermost row may vary by less than 10% from that of the cutting tip of the innermost row, in one embodiment, and by less than 5% in another embodiment. Other inserts along the cutting profile may have similar deviations from the substantially constant radius of curvature.

Another way of determining the relative extensions of cutting elements 137 is by comparing the extension height of one cutting element from the surrounding land surface of the cone to the extension height of other cutting elements. For example, the extension height of innermost row 137*c* may be no more than 30% of the extension height of outermost row 137*a* (and may range from 8 to 15% of the extension height of outermost row 137*a* in another embodiment). Additionally, at least one mid row 137*b* may have an extension height ranging from 50 to 85% of outermost row 137*a* (and may range from 65 to 80% of the extension height of outermost row 137*a* in another embodiment). Further, in embodiments having at least one mid row 137*bc*, the at least one mid row 137*bc* may have an extension height ranging from 20 to 60% of outermost row 137*a* (and may range from 35 to 55% of outermost row 137*a* in another embodiment). Finally, in embodiments having at least one mid row 137*ab*, the at least one mid row 137*ab* may have an extension height ranging from 85 to 100% of outermost row 137*a* (and may range from 90 to 100% of outermost row 137*a* in other embodiments).

In addition to varying extension heights, the different rows of cutting elements 137 may also vary in their radius of curvature at their cutting tip, with outermost row 137*a* having a smaller radius, as compared to mid row 137*b*, which is smaller than that of innermost row 137*c*. These radii may vary according to the varying cutting function between the rows of cutting elements. Specifically, outermost row 137*a* may primary cut the bottom hole, whereas mid row 137*b* may cut the bottom, corner and/or sidewall and innermost row 137*c* may primarily cut the corner (or sidewall) and maintain gauge of the hole. However, one skilled in the art should appreciate after learning the teachings related to the present invention contained in this invention that such "curvature" may depend on the type of cutting element shape selected. For example, the types of shapes which may be used include chisel, conical, bowed or flat slant crested, semi-round top, DOG BONE®, or any other possible shapes yielding a desired functionality, or combinations thereof. Further, desired extension and sharpness may be determined from the penetration depth and cutting action, i.e., the outer rows have larger penetration and less shearing and inner rows have less penetration and larger scraping to cut gauge.

In embodiments in which the cutting profile has a substantially constant radius of curvature, to account for the varying extension heights between the rows of cutting elements, the cone radius (measured to the actual cone, not to the cutting element tip) may increase from the position of the outermost row 137*a* to the nose of cone 136 (actual cone apex, not considering the cutting elements) centered between innermost row 137*c* of cutting elements. For example, in particular embodiments, the nose height (at the steel cone, not to the cutting element tip) to outer cone diameter (at the steel cone, not to the cutting element tip) range may be less than 0.65 or less than 0.63, and in some embodiments, may range from 0.51 to 0.60, and from 0.55 to 0.59 in particular embodiments. In even more particular embodiments, these cone dimensions (resulting in the cone shape) may be used on a bit having three cones. Further, while such cone profile may be needed to produce a substantially constant cutting profile curvature, such cone geometry may also be used in embodiments that do not have a substantially constant cutting profile curvature.

Figure 12:
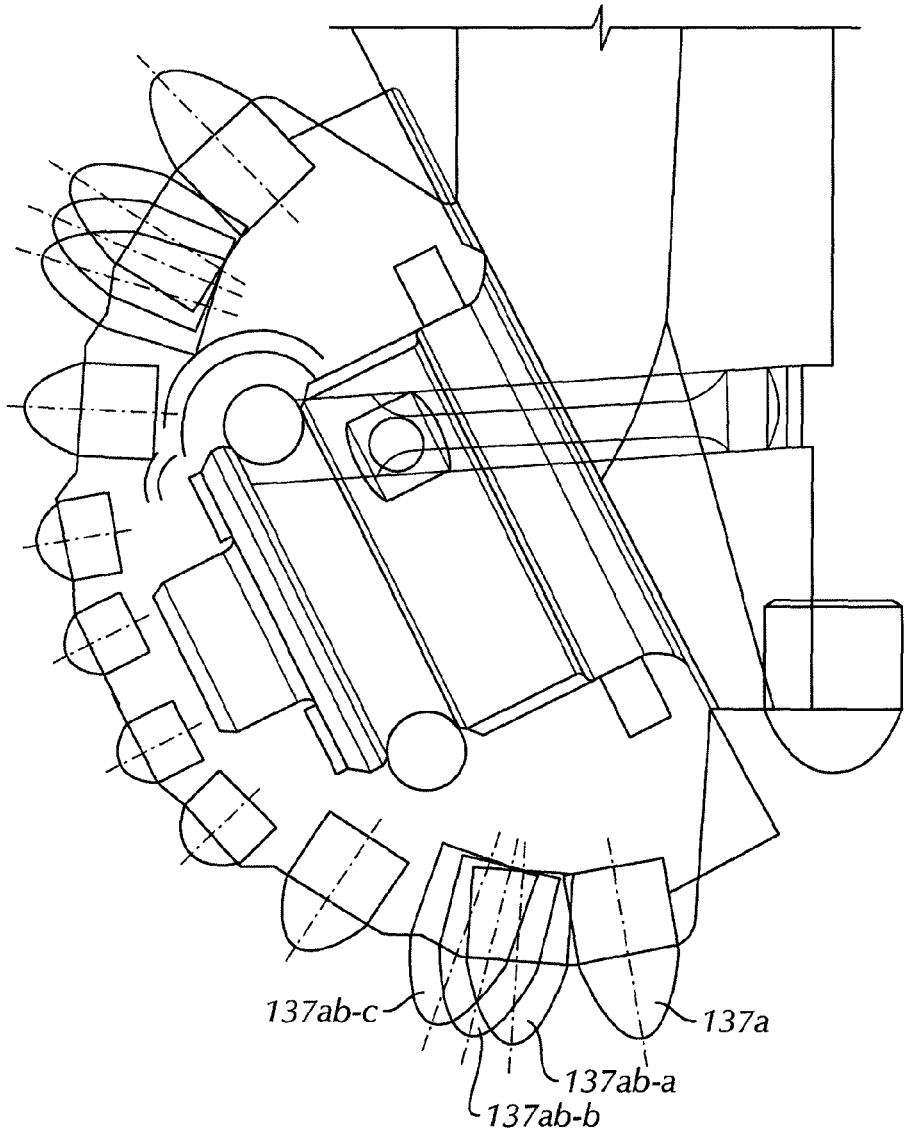
FIG. 12 shows overlay cutting profiles of three roller cones according to one embodiment of the present disclosure.

Further, while as described above, different size cones may be used, in accordance with various embodiments of the present disclosure, cones may be provided with varying cutting structures and/or profiles. For example, in one embodiment, the spacing between rows may differ among the cones, as shown in FIG. 12. Referring to FIG. 12, row 137*ab* (row 137*ab-a*, row 137*ab-b*, row 137*ab-c*) may vary in spacing with respect to row 137*a* for each of the three cones (cone a, cone b, cone c). However, in other embodiments, spacing between other rows and/or cutting element geometry and cutting profiles may vary between any cones.

Figure 13A:
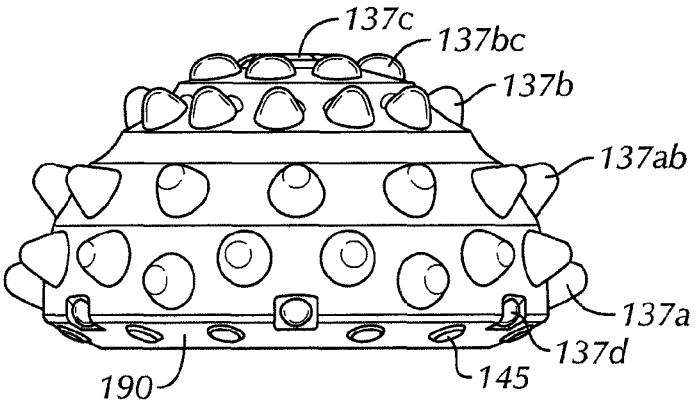
FIGS. 13A-C show a side, cross-section, and top view of a roller cone according to one embodiment of the present disclosure.
Figure 13B:
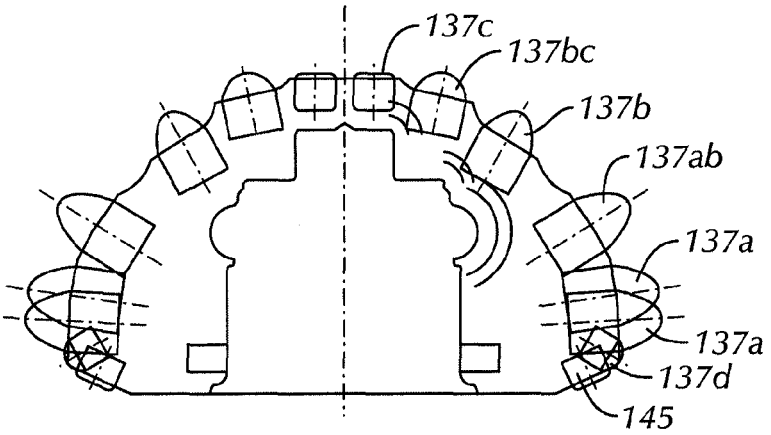
Figure 13C:
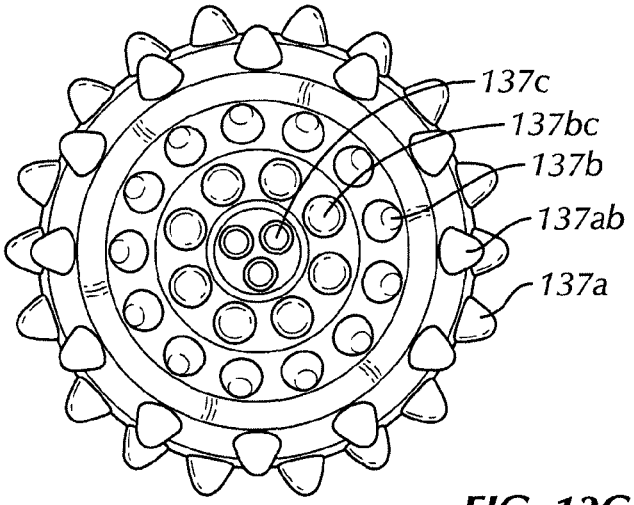

Further, in addition to the cutting structure shown in FIG. 11, there may be variations on the number of rows, types of rows, etc., that are within the scope of the present disclosure. Referring to FIGS. 13A to 13C, a cross-sectional, side, and top view of an alternative cone and cutting structure are shown. As shown in FIGS. 13A to 13C, cone 136 may include an outermost row of cutting elements 137*a* having the greatest extension height, a plurality of mid rows 137*b*, and an inner most row 137*c*. Of the plurality of mid rows 137*b*, some of such rows may include cutting elements more similar to outermost row 137*a* or innermost row 137*c*. For example, mid row 137*ab* has the same extension height:diameter ratio as outermost row 137*a*. Thus, in particular embodiments, the outermost row(s) of cutting elements may have an extension height:diameter ratio ranging from 0.675 to 0.76 in some embodiments, and between 0.70 and 0.74 in other embodiments. Additionally, outermost row 137*a* may include staggered inserts, forming a non-linear row (comparing the apex of each of the inserts), with bases that overlap the average apex position. In particular embodiments, the non-linear row may take a sinusoidal shape, such as described in U.S. Patent Publication No. 2007/0114072, which is assigned to the present assignee and herein incorporated by reference in its entirety. Use of such non-linear row may allow for the number of cutting elements present on the row to be increased (such as to include at least 50% more inserts, equivalent to one and half rows. Outermost row 137*a* may also be considered to be two continuous rows, one containing a "full" set of inserts and one containing less than a "full" set of inserts. Use of a non-linear row or two continuous rows may allow for increased number of cutting elements from the same cone close to the bit center to cut the core, whereas in conventional roller cone bits, the cutting elements of each cone typically intermesh in cutting with the other two cones.

While the embodiment shown in FIGS. 11A-B included a mid row 137*bc* neighboring the innermost row 137*c* having a very similar extension height:diameter ratio, the embodiment shown in FIGS. 13A-13C possesses a mid row 137*bc* that does not possess as low of an extension height:diameter ratio as innermost row 137*c*, but does have a relatively lower extension height:diameter ratio as compared to mid row 137*b*. In particular, one or more innermost row(s) may include rows having a cutting element extension height:diameter ratio of less than 0.48, and less than 0.45 in other embodiments. At least one of the innermost row(s) may have a cutting element extension height:diameter ratio of less than 0.2, or less than 0.15 in other embodiments. In addition to the innermost row (s) and outermost row(s), there is at least one mid row 137*b* having an extension height:diameter ratio between that of the innermost row(s) and outermost row(s). For example, such elements may have an extension height:diameter ratio between 0.52 and 0.7 in one embodiment, and between 0.58 and 0.65.

As described above, outermost row 137*a* may primarily cut the bottom hole, whereas mid row 137*b* may cut the bottom, corner and/or sidewall and innermost row 137*c* may primarily cut the corner (or sidewall) and maintain gauge of the hole. In addition to these rows and cutting functions, as shown in FIG. 13A and 13B, a row 137*d* may be provided adjacent the core-facing surface 190 (frequently referred to as the heel surface in conventional roller cone bits or as the cone backface). Such row 137*d* may serve to help cut the center core of formation. Further, at least one row of wear protection elements 145 may be provided on the core-facing surface 190 to help prevent wear, abrasion, and erosion of the cone backface 190, aid in cutting of the core and/or to help prevent seal failure.

Figure 14A:
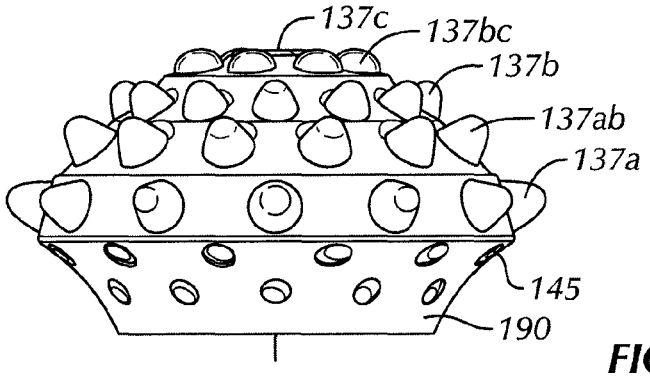
FIGS. 14A-C show a side, cross-section, and top view of a roller cone according to one embodiment of the present disclosure.
Figure 14B:
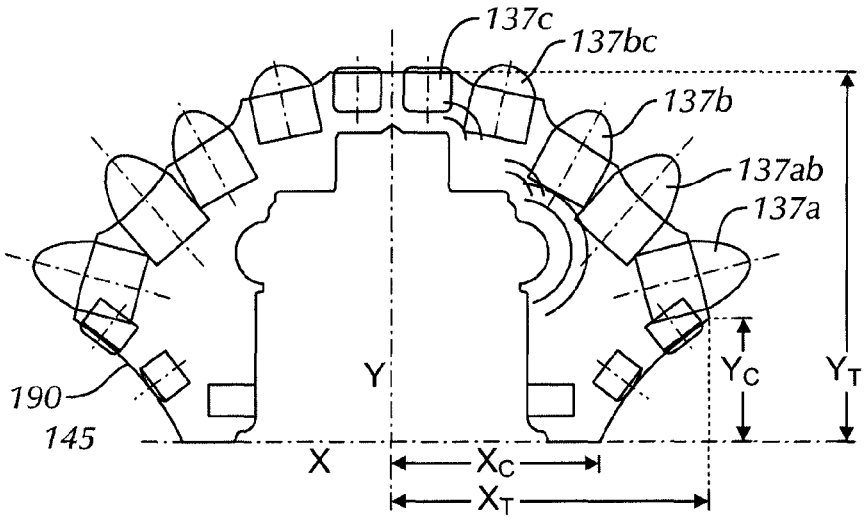
Figure 14C:
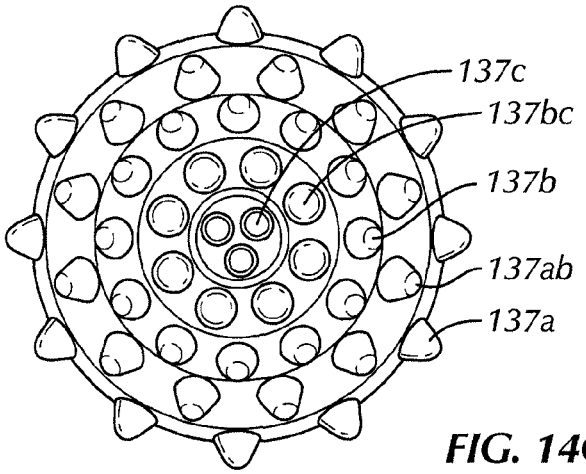

Referring to FIGS. 14A to 14C, a cross-sectional, side, and top view of an alternative cone and cutting structure are shown. As shown in FIGS. 14A to 14C, cone 136 may include an outermost row of cutting elements 137*a* having the greatest extension height, a plurality of mid rows 137*b*, and an inner most row 137*c*. The rows 137*a*, 137*b*, and 137*c* may have similar extension height:diameter ratio as described with respect to FIGS. 13A to 13C. However, as shown in FIG. 14A and 14B, cone 136 has a core-facing surface 190 that is a concave or scalloped surface extending around the entire circumference of the cone 136. When viewing the cone 136 as a cross-section along the x-y plane, the concave surface is formed on the diagonal, extending from an x-axis location of $X_C$ to a y-axis location of $Y_C$. The length of $X_C$ may range from 0.6 to 0.8 times that of the total length $X_T$, which is the greatest radius of cone 136. Similarly, the length of $Y_C$ may range from 0.25 to 0.4 times that of the total length $Y_T$.

Figure 15:
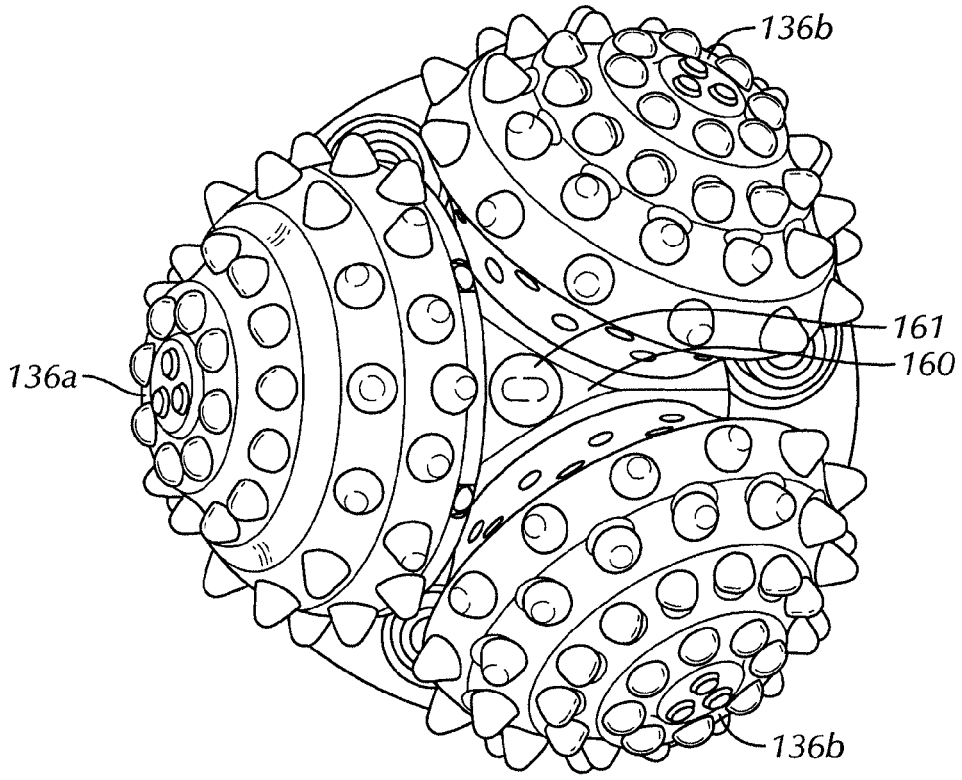
FIG. 15 shows a bottom view of a drill bit according to one embodiment of the present disclosure.

It is also within the scope of the present disclosure that different cone sizes 136*a* and 136*b*, such as illustrated in FIG. 6 and FIG. 15, may also be included on bits 130 having identical journal angles ϕ and no axial separation y. Further, bit size (outer bit or "gage" diameter) may be determined based on the particular journal angle and cone size combination. For example, in a particular embodiment, the cone shown in FIG. 13A-C, referred to as 136*a* in FIG. 15, may be used in combination with two cones of that shown in FIG. 14A-C, referred to as 136*b* in FIG. 15. In such an embodiment, the scalloped backface may allow for maximizing cone size without interference between adjacent cones Additionally, one or more rows of cutting elements 137 may include polycrystalline diamond. Specifically, one or more rows of cutting elements may include a tungsten carbide base and a diamond enhanced tip or may be formed entirely of diamond (including thermally stable polycrystalline diamond). In a particular embodiment, innermost row 137*c* (and/or mid row 137*bc* may include polycrystalline diamond).

Further, it is also within the scope of the present disclosure that the twist angle or orientation of crest may be selected to minimize or maximize scraping and/or to ensure that the inserts possess the amount of drag required to break the formation. Further, the angle of the element with respect to the cone surface may also be altered (other than 90°) to change the insert attack angle (or angle of incidence) with respect to the formation. In some embodiments, if the insert axis were projected downward, the insert angle will intersect the cone axis, but in other embodiments, it does not.

In general, a conventional (inwardly journaled) three-cone drill bit will have about 17 percent to 25 percent bottom hole coverage. As used herein, "bottom hole coverage" refers to the percentage of bottom hole area contacted by cutting elements on the roller cones during one complete rotation of the drill bit. Bottom hole coverage is typically expressed as a percentage of the total area of the hole determined by the gauge diameter of the drill bit. The amount of bottom hole coverage varies depending on the number of contact points (i.e., the number of cutting elements), as well as the ratio of roller cone revolutions to bit revolutions. The shape and orientation (e.g. journal angle and cone offset angle) of the roller cone also affect the bottom hole coverage. For example, by increasing the cone offset angle, the contact area of each contact point is increased by causing the cutting element to scrape along the bottom of the hole, which increases the bottom hole coverage. One of ordinary skill in the art will appreciate that bottom hole coverage may be varied depending on the physical properties (e.g. hardness) of the earth formation being drilled. For example, for "brittle" formation, the bits of the present disclosure may possess a bottom hole coverage ranging from 25 to 30%, while the coverage may range from 30 to 35% for "plastic" formations.

Those having ordinary skill in the art will appreciate that several methods are available for determining the number of contact points and bottom hole coverage. For example, a designer may manually determine the number of contact points by calculating the location of the cutting elements through all or a portion of a rotation of the drill bit. The bottom hole coverage may be determined by calculating the depth at which each cutting elements penetrates and combining that calculation with the location and quantity of the contact points. Drilling simulations may also be performed to determine the number of contact points and bottom hole coverage. One example of a suitable drilling simulation method that may be used for this purpose is U.S. Pat. No. 6,516,293, entitled "Method for Simulating Drilling of Roller Cone Bits and its Application to Roller Cone Bit Design and Performance," which is assigned to the assignee of the present invention and incorporated herein by reference in its entirety. In accordance with some embodiments of the present disclosure, the bottom hole coverage may be greater than 25 percent, and may range from 25 to 35 percent in particular embodiments.

In addition to active cutting by cutting elements 137 on cones 136, there may be a center core spacing 160 between cones 136. This spacing may be selected based on the type of formation to be drilled, for example. In a particular embodiment, the radius of center core spacing 160 may be calculated as the distance of the nearest cone to the bit centerline and may range from 0 to 20% of the bit radius, in various embodiments. A center core spacing of zero may be achieved when the at least one cone touches the bit centerline. When the center core spacing is greater than zero, a center insert 161 may optionally be provided in the center core spacing 160 to aid in compressive loading on (and ultimate failure of) the center core of rock not cut by cones 136. Alternatively, a center jet (not shown) may be provided in the center core spacing 160 instead of or in addition to center insert 161.

In addition to the optional center jet (not shown), embodiments of the present disclosure may have various hydraulic arrangements to direct drilling fluid from the drill string to outside of the bit. Specifically, referring to FIGS. 16 and 17, drilling fluid is directed within the hollow pin end 134 of the bit 130 to an interior plenum chamber 170 formed in the bit body 132. The fluid is then directed through hydraulic fluid passageway 171 out of the bit through the one or more nozzles 172 on bit 130. In some embodiments, there may be at least one nozzle spaced between each pair of neighboring cones; however, in other embodiments, one or more nozzles may be omitted from between one or more pairs of neighboring cones. Further, in particular embodiments, there may be two nozzles provided between at least one pair of neighboring cones. Nozzles 172 may be individually oriented based the desired hydraulic function: cutting structure or cone cleaning, bottom hole cleaning, and/or cuttings evacuation.

Figure 18:
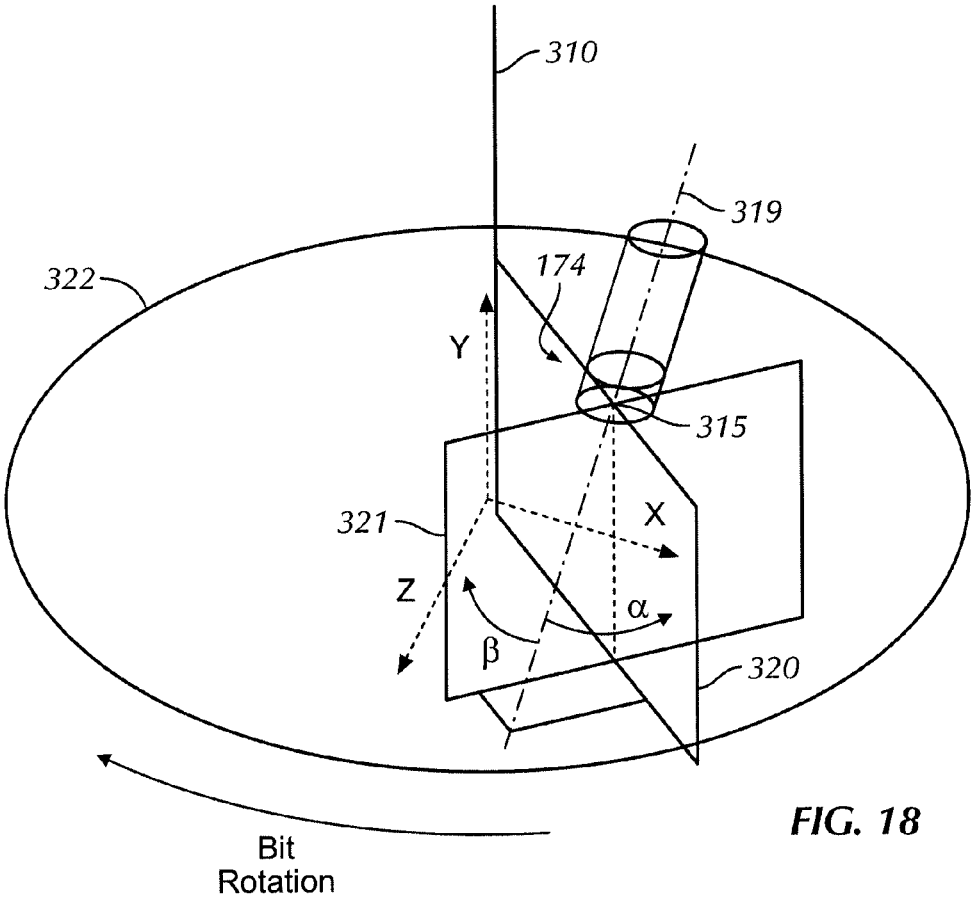
FIG. 18 shows the orientation definitions for a nozzle in space.

To understand the orientation of the nozzle, it is useful to define an orientation system to describe how a nozzle may be oriented within the bit body. FIG. 18 shows a nozzle receptacle 174. The position of the receptacle 174 is defined by three translational dimensions X, Y, and Z, and the orientation is defined by two vector angles, lateral angle β and radial angle δ. The coordinate system for the X, Y, and Z dimensions is located along the bit centerline axis 310 and is fixed relative to the bit body (not shown). A nozzle receptacle center point 315 is located at the desired position by setting the values of X, Y and Z. The receptacle center point 315 is located on the external bit body surface, usually identified by a spot face, where the nozzle receptacle exits the bit or on the spot face of an attachable tube. The orientation of the nozzle receptacle is set by adjusting the values of lateral angle β and radial angle α. As used herein, the lateral angle β is the angle between the nozzle receptacle centerline 319 and the reference plane 320 that passes through the bit centerline axis 310 and the nozzle receptacle center point 315. As used herein, radial angle α is the angle between the nozzle receptacle centerline 319 and the reference plane 321, which is perpendicular to reference plane 320 and passes through the nozzle receptacle center point 315. Increasing and decreasing lateral angle β affects the circumferential movement of the fluid around the bore hole 322. Increasing and decreasing the size of radial angle α directs the fluid away from or toward the bit centerline axis 310. As used herein, values for a lateral angle β and radial angle a are absolute values of the respective angle (i.e. without regard to positive or negative). The direction of the fluid could also be changed by the installation of a nozzle in the nozzle receptacle 130 that directed the fluid vector in a direction other than that defined by the nozzle receptacle centerline 319. It should be appreciated by one skilled in the art after learning the teachings related to the present invention contained in this invention that using a nozzle to adjust the direction of the fluid would be equivalent to machining the nozzle bore such that it accomplished the same hydraulic purpose.

Lateral and radial angles of nozzles may be individually selected based to result in the best cone-cleaning efficiency. In particular embodiments, the nozzles may be oriented to ensure flow pathlines over the nose of the cone, to help cool and clean the inserts in the nose region (the innermost row 137*c* as well as mid row 137*b*) as these inserts are in substantially continuous contact with the formation, and may, in particular embodiments, include a diamond layer or be formed from diamond, particularly necessitating cooling by the fluid.

To improve bottom hole cleaning, nozzles may be arranged such that the drilling fluid contacts the bore hole bottom with maximum or near-maximum "impingement pressure." "Impingement pressure" as used herein refers to the force directed into the earth formation by the fluid exiting from the nozzle divided by the area of the fluid from the nozzle. The further the nozzle exit is offset from the hole bottom, the more the velocity of the fluid is reduced (because the fluid exiting the nozzle has longer to interact with surrounding fluid), which in turn causes a reduction in the impingement pressure. Thus, where greater impingement pressure for bottom hole cleaning is desired, an extended nozzle may be used (instead of, for example, an embedded nozzle).

The lateral and radial angles of the nozzle also affects the distance to the hole bottom, and thus, affects the impingement pressure. If the radial and lateral angles are 0 degrees, the nozzle axis would be substantially parallel to the axis of the drill bit. A higher lateral angle is typically used to aim the fluid towards a roller cone. As the lateral angle of the nozzle is increased to improve cone cleaning, the distance to the hole bottom is also typically increased. In a particular embodiment, the nozzles may have a lateral angle between 6 and 10 degrees, and about 8 degrees in another embodiment. In a particular embodiment, the fluid stream may be oriented at the nose of the cone to provide cooling of the cutting elements located near the nose of the cone. The increased distance to the hole bottom is one factor that contributes to the reduced impingement pressure on the hole bottom, such as when the nozzle is cleaning the cutting structure. In addition to impingement pressure, bottom hole cleaning is also affected by fluid inclination angle, nozzle geometry, fluid velocity profile (fluid interaction zones and bit interaction zones). Additionally, in the embodiment where a bit has one cone of different shape and size than the other cones, a better hydraulic design may be achieved by designing each nozzle with a different angle; however, individual selection of nozzle orientations may be made for each nozzle irrespective of cone size. Further, because of the particular cone arrangement when using such different cones, the center portion bounded by the three cones may form a relatively larger opening, which may be beneficial to cutting evacuation.

Figure 17:
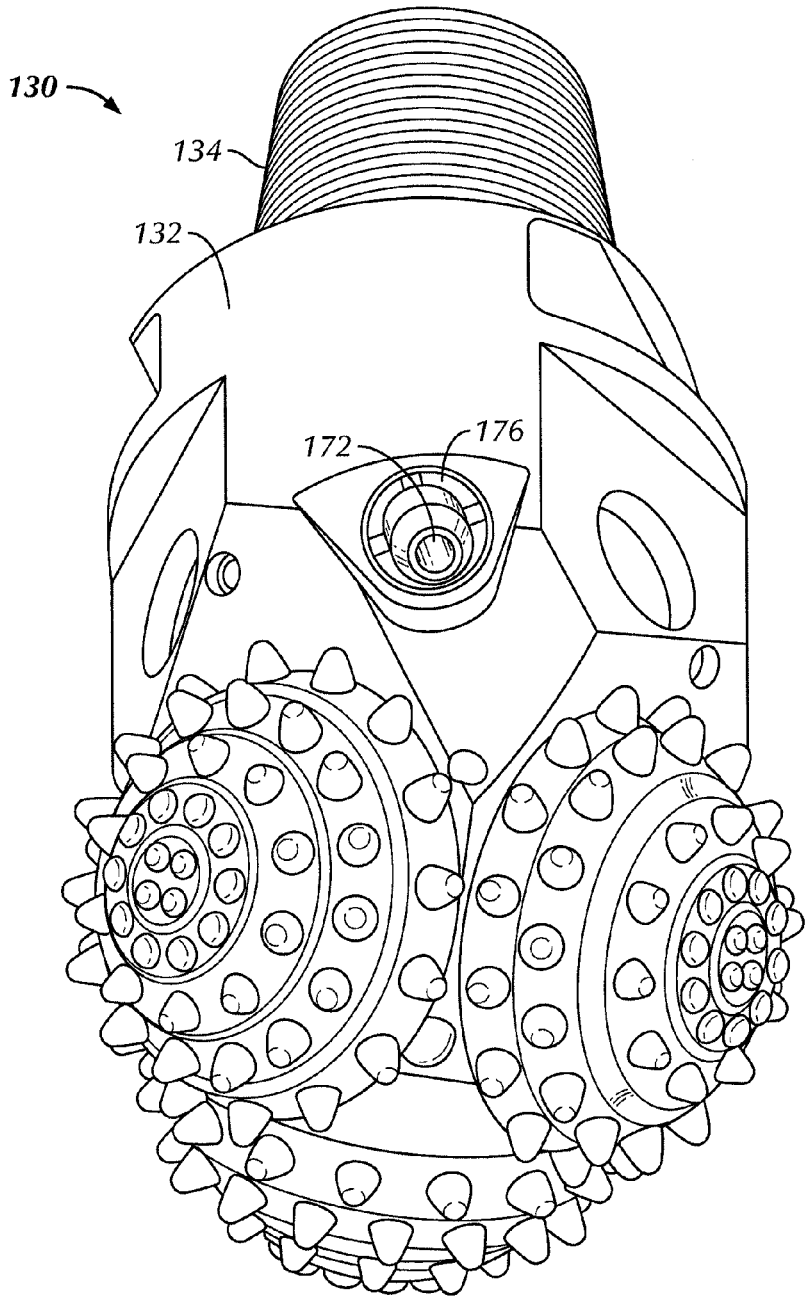
FIG. 17 shows a perspective view of a drill bit according to one embodiment of the present disclosure.
Figure 19:
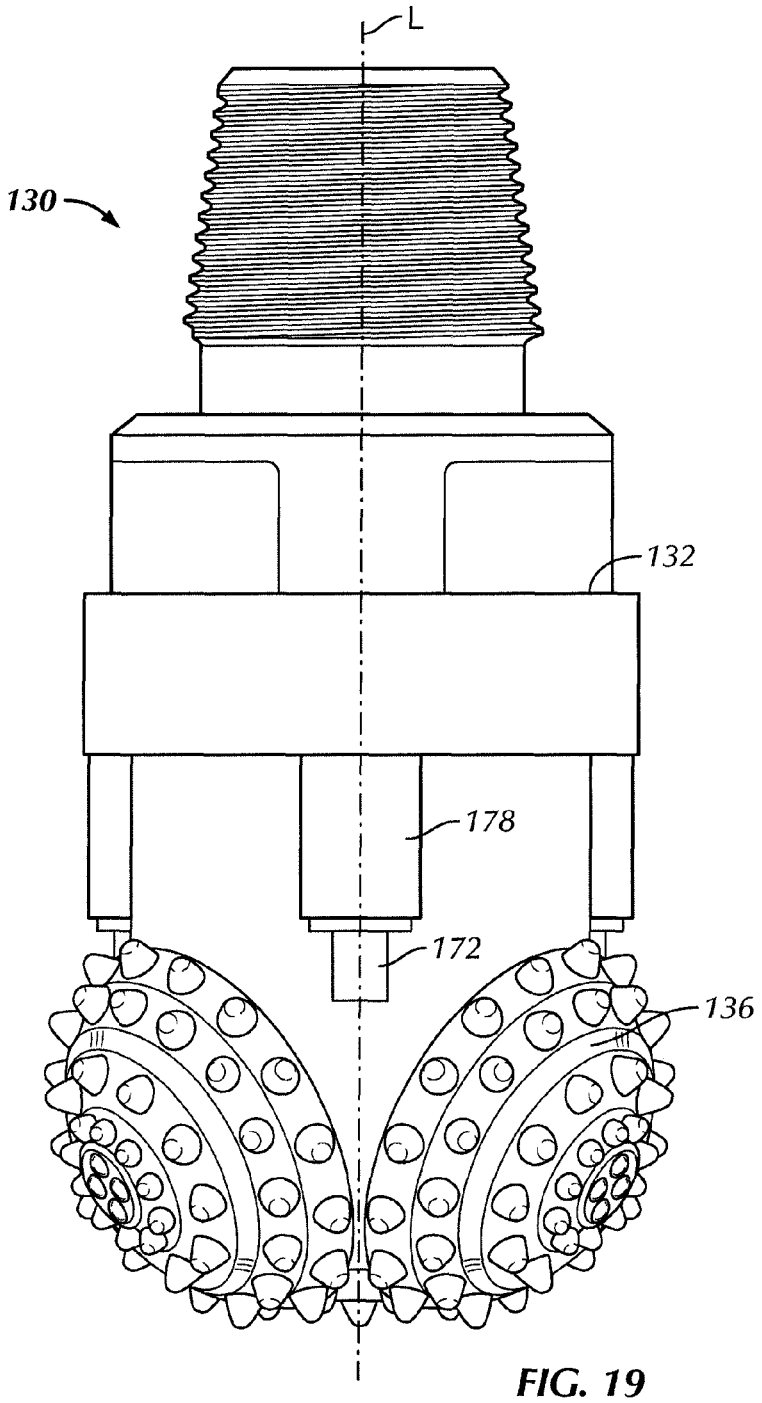
FIG. 19 shows a side view of a drill bit according to one embodiment of the present disclosure.

Various hydraulic configurations (number, type, placement, orientation of nozzles) may be used to optimize or balance between cutting structure cleaning, bottom hole cleaning, cuttings evacuation, etc. For example, nozzles 172 may be placed the outer circumference of bit body 130 (circumferentially spaced as shown in FIGS. 17 and 19), and/or may include a center nozzle or jet (not shown) substantially aligned with axis L of bit 130. Nozzles on the outer circumference may extend from openings or nozzle bores 176 formed in bit body 132 and/or may be extend from attachment pieces (as discussed in U.S. Pat. No. 6,763,902 which is assigned to the present assignee and herein incorporated by reference in its entirety) fit into pockets formed in bit body 132. Additionally, extended hydraulic attachments 178 (extending to proximate a bottom hole) may also be used, whereby the end of the nozzle 172 extends below the uppermost portion of cone 136 (as shown in FIG. 19). Depending on the placement of the hydraulic pieces (and how close the pieces are to gage), it may be desirable to include one or more gauge or lug pads to help maintain gage and reduce damage to the hydraulic components. Further, it is also within the scope of the present disclosure that no hydraulic outlet is present between one pair of neighboring cones, which may be desirable for achieving cross-flow.

Figure 20A:
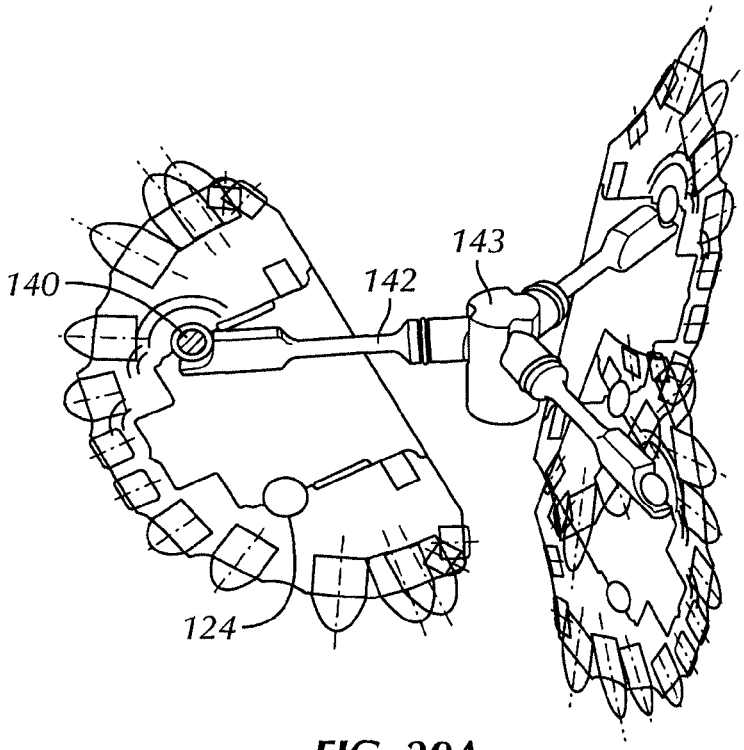
FIGS. 20A-B show embodiments for retaining cones on a roller cone bit in accordance with embodiments of the present disclosure.

Additionally, for a three cone bit having ball passages 141 that intersect, cones may be retained on journal 135 by installation of balls 140 through ball passage 141 into ball race 139*a*. A ball retainer 142 (having one end shaped to compliment the ball race 124 geometry) may be inserted into ball passage and welded or otherwise plugged in place to keep balls 140 in ball races and cone 136 on journal 135. For example, as shown in FIG. 20A, after balls 140 are inserted into ball passage (141 in FIG. 16) to fill ball race (139*a* in FIG. 9) and after ball retainers 142 are inserted to the ball passage behind balls 140 a single, center plug 143 may be inserted through a center hole (machined into the bit body at its the lowest axial position). Center plug 143 may operate to keep ball retainers 142 in place, while an optional back hole plug (144 in FIG. 16) may also be inserted into ball passage 141 to prevent debris, fluid, etc., from filling ball passage. In the embodiment shown in FIG. 20A, once in place, each of the ball retainers 142 extend a distance from the ball race to less than the centerline of the bit.

Figure 20B:
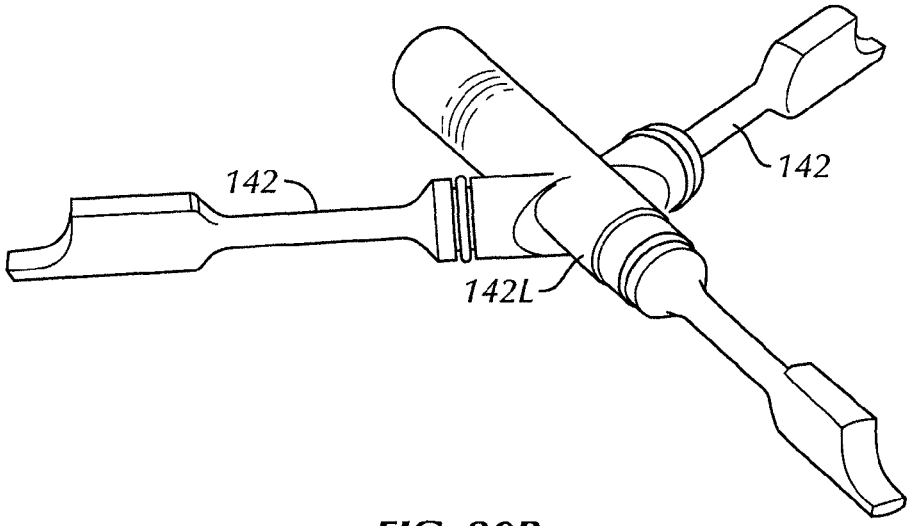

Alternatively, two "short" retainers 142, similar to those shown in FIG. 20A, may be used in conjunction with a "long" ball retainer 142L (extending a distance greater than that between the race 124 and the centerline), as shown in FIG. 20B. One end of the ball retainers 142 and 142L are shaped to compliment the ball race 139*a* geometry, while the other ends of the retainers 142 are shaped to compliment the geometry of the long retainer 142L (whereas retainers 142 are shaped to compliment the center plug 143 in the embodiment shown in FIG. 20A). Thus, long retainer 142L serves to keep ball retainers 142 and itself (through its dimensions) in place. Optional back hole plugs (144 in FIG. 16) may also be inserted into ball passage 141 behind short retainers 142 to prevent debris, fluid, etc., from filling ball passage 141.

Figure 16:
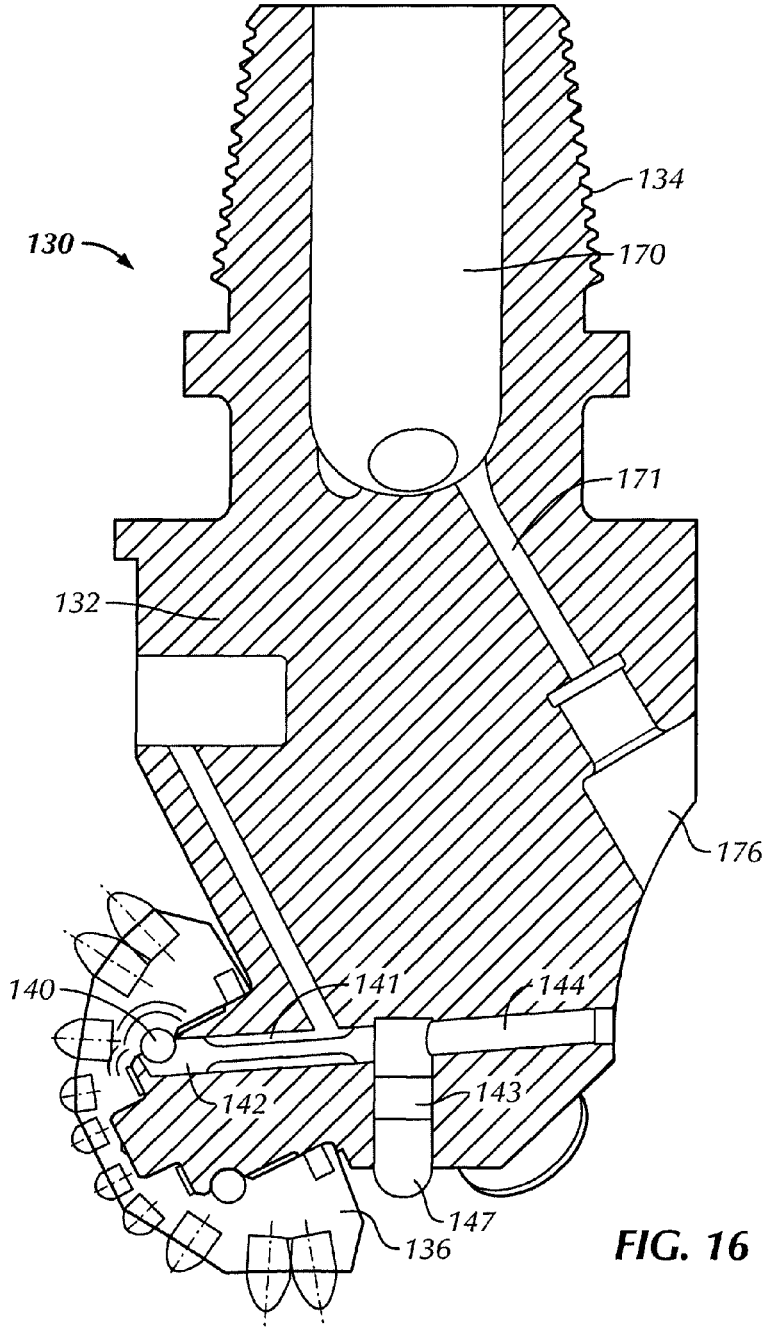
FIG. 16 shows a cross-sectional view of a drill bit according to one embodiment of the present disclosure.

When a center hole is formed in bit body to receive a center plug 143, a center insert 147, as shown in FIG. 16, may optionally be inserted therein, to assist in cutting of a center core of formation. Alternatively, even when a center plug is not used (such as when using a long retainer in combination with the short retainers), it may still be desirable to include such a center insert, for assistance in cutting the center core.

FIGS. 26A-29C also shows an exemplary retention system wherein ball passages intersect. Specifically, in FIGS. 26A and 26B, a ball retainer 142 has a ball retention end 142*a* and a plug end 142*b*. A seal 146, such as an o-ring, is fitted within a groove around the circumference of the plug end 142*b* to help the ball retainer stay in place and to isolate the lubricant system for each cone. The seal 146 may also provide a dampening effect from internal vibrations. As seen in FIGS. 27A and 27B, a center plug 143 may then be inserted into a center hole in the lower end of a bit body (not shown), wherein a portion of the plug end 142*b* of each ball retainer 142 fits within grooves 143*a* formed in the center plug. The grooves 143*a* act as a locking mechanism to hold the ball retainer 142 in place. The circumference of the center plug 143 may be slightly smaller, e.g., 0.005 inches smaller, than the circumference of the center hole. Additional mechanisms may then optimally be used to secure the center plug 143 into place. For example, as seen in FIGS. 27A-29C, blind holes 143*b* may be drilled at spaces around the circumference of the center plug 143, between the grooves 143*a*. A back plug 144 having a tapered end 144*a* may then be inserted into the ball hole plug hole on the bit body (not shown), wherein the tapered end 144*a* fits into the blind hole 143*a* of the center plug 143, thereby locking the center plug 143 into place (e.g., preventing the center plug from rotating and restricting parallel movement through the center hole). The back plug 144 may be welded, or otherwise secured into place. In some embodiments, the center plug may be further secured into place by JB welding an epoxy material to the grooves and/or tip of the center plug 143 prior to inserting the center plug 143 into the center hole. Further, as seen in FIGS. 28A-29B, the center plug 143 may be secured into place by inserting a center insert 147 into the center hole, wherein the center inset 147 fits into the center hole by interference fit, thereby holding the center plug 143 in place.

In embodiments using the retention system shown in FIGS. 26A-29C, a ball retainer 142 with a seal 146 may be inserted into a ball passage one at a time. A center plug 143 with slightly tapered grooved wedges 143*a* may then be inserted into a center hole, wherein the plug end 142*b* of each ball retainer 142 fits within the center plug grooves 143*a*. Optionally, epoxy material may be JB welded to the grooves 143*a* of the center plug 143 and/or on the tip, permanently securing the center plug 143 into place. Alternatively, or in addition to JB welding, a center insert 147 may be used to secure the center plug 143 into place. A center insert 147 may fit within the center hole by interference fit, thereby having enough force to hold the center plug 143 in place. The center insert 147 may be removed for repairs. Because welding is not necessary in such a system, the chamfer that is found on other center plugs may be removed.

EXAMPLES

Figure 21:
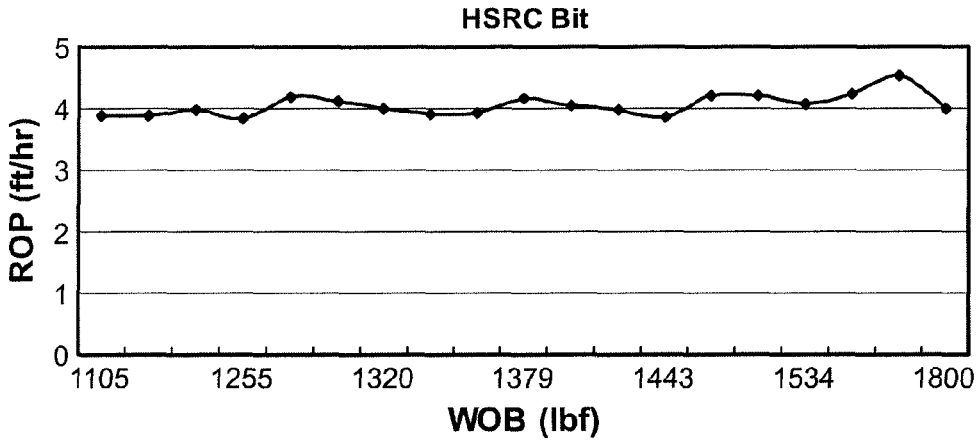
FIG. 21 shows a rate of penetration plot for a drill bit of the present disclosure.
Figure 22:
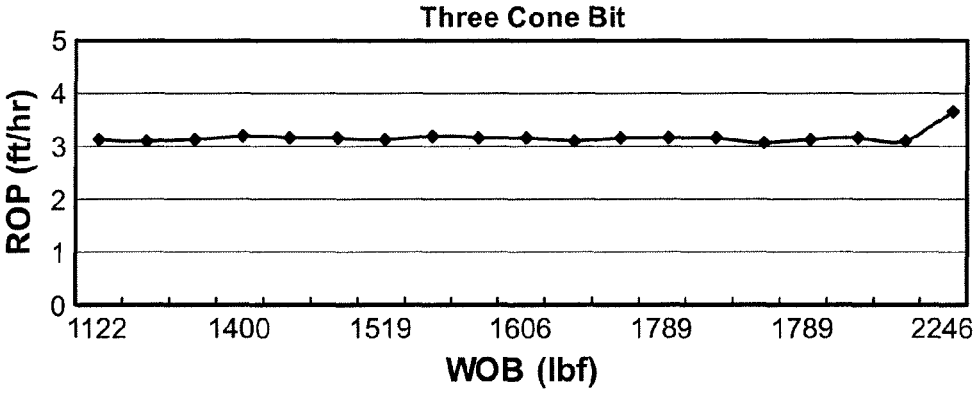
FIG. 22 shows a rate of penetration plot for a conventional roller cone drill bit.
Figure 23:
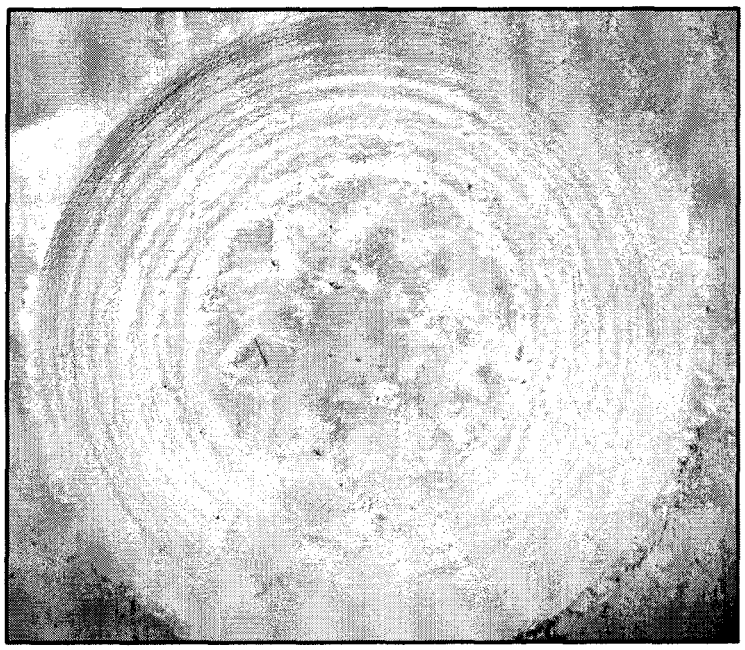
FIG. 23 shows a cutting pattern for a drill bit of the present disclosure.
Figure 24:
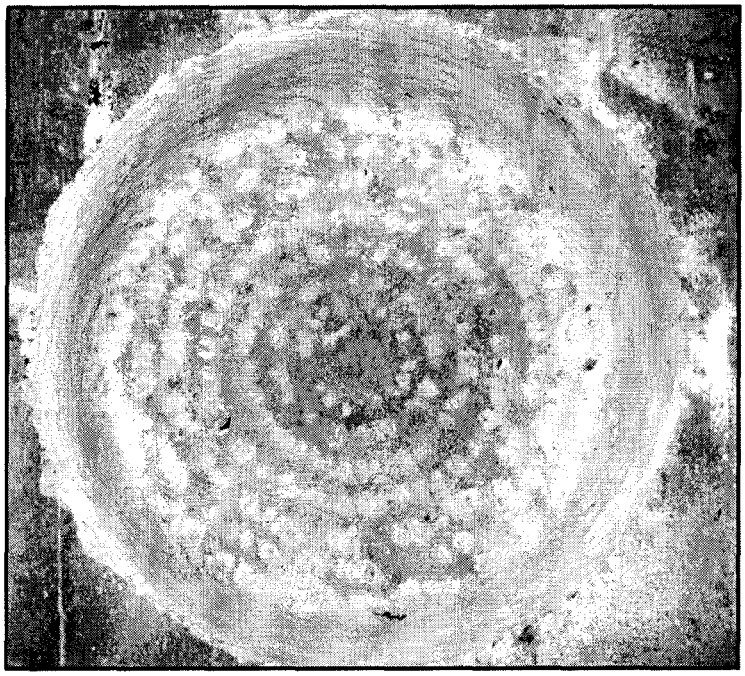
FIG. 24 shows a cutting pattern for a conventional roller cone drill bit.

To demonstrate the effectiveness of a drill bit formed in accordance with some embodiments of the present disclosure, a three cone test bit (with outwardly facing journals) was compared to an F15 TCI conventional three cone bit (with inwardly directed journals and cones). The two bits were applied to a limestone slab with 60 rpm and a weight on bit of 1-2 kilopound-force. The resulting rates of penetration are shown in FIGS. 21 and 22, for the test bit and F15, respectively. Additionally, the cutting patterns for the test bit and F15 are shown in FIGS. 23 and 24, respectively. The cutting pattern for the test bit shows a clear path generated by a shearing action, which is consistent with the cutting pattern predicted by a computer simulation.

Embodiments of the present disclosure may provide for at least one of the following advantages. The use of an outwardly directed journal and cone may provide for a complex trajectory that may combine crushing/indentation and shearing, increasing the efficiency in cutting or destructing a rock formation. The arrangement may also provide a bit that is suitable for directional drilling and that holds good toolface angle during drilling. Further, use of the outwardly facing cones allows for stronger cone retention and minimized stress on the journal and bit body.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A drill bit, comprising:

a bit body, comprising:

at the upper end of the bit body, a connection adapted to connect to a drill string; and at the lower end of the bit body, a plurality of journals extending downwardly and radially outward from a longitudinal axis of the bit;

a plurality of roller cones rotatably mounted on the plurality of journals; and at least three rows of cutting elements disposed on each of the plurality of roller cones, wherein the cutting elements of an outermost row have an extension height to diameter ratio greater than the cutting elements of a mid row, and the cutting elements of the mid row have an extension height to diameter ratio greater than the cutting elements of an innermost row.

2. The drill bit of claim 1, further comprising at least two additional rows of cutting elements disposed on each of the plurality of roller cones.

3. The drill bit of claim 2, wherein one of the at least two additional rows of cutting elements has an extension height to diameter ratio substantially the same as the outermost row.

4. The drill bit of claim 2, wherein one of the at least two additional rows of cutting elements has an extension height to diameter ratio substantially the same as the innermost row.

5. The drill bit of claim 1, wherein the at least three rows of cutting elements is arranged to provide greater than about 25 percent bottom hole coverage per revolution of the drill bit.

6. The drill bit of claim 1, wherein at least one of the mid row or innermost row comprises diamond.

7. A drill bit, comprising:

a bit body, comprising:

at the upper end of the bit body, a connection adapted to connect to a drill string; and at the lower end of the bit body, a plurality of journals extending downwardly and radially outward from a longitudinal axis of the bit;

a plurality of roller cones rotatably mounted on the plurality of journals, wherein at least one of the plurality of roller cones has a nose height to outer cone diameter ratio of greater than about 0.5; and a plurality of cutting elements disposed on the plurality of roller cones.

8. The drill bit of claim 7, wherein the plurality of cutting elements are arranged in at least three rows on each of the plurality of cones.

9. The drill bit of claim 8, further comprising at least two additional rows of cutting elements disposed on each of the plurality of roller cones.

10. The drill bit of claim 7, wherein the plurality of cutting elements is arranged to provide greater than about 25 percent bottom hole coverage per revolution of the drill bit.

11. The drill bit of claim 7, wherein at least one of the mid row or innermost row comprises diamond.

12. The drill bit of claim 7, wherein the plurality of cutting elements define a cutting profile having a substantially constant radius of curvature.

13. A drill bit, comprising:

a bit body, comprising:

at the upper end of the bit body, a connection adapted to connect to a drill string; and at the lower end of the bit body, a plurality of journals extending downwardly and radially outward from a longitudinal axis of the bit;

a plurality of roller cones rotatably mounted on the plurality of journals;

a plurality of cutting elements disposed on the plurality of roller cones; and a plurality of nozzles inserted into nozzle bores formed on an outer circumference of the bit body, wherein an orientation of at least one nozzle of the plurality of nozzles has at least one of a lateral angle and radial angle.

14. The drill bit of claim 13, further comprising:

a center jet attached to a bore formed in the lower end of the bit body.

15. The drill bit of claim 13, wherein an end of at least one of the plurality of nozzles extends below an uppermost portion of at least one of the plurality of cones.

16. The drill bit of claim 13, wherein at least one nozzle of the plurality of nozzles is between each pair of neighboring cones.

17. The drill bit of claim 13, wherein between one pair of neighboring cones, there is no nozzle.

18. A drill bit, comprising:

a bit body, comprising:

at an upper end of the bit body, a connection adapted to connect to a drill string; and at a lower end of the bit body, a plurality of journals extending downwardly and radially outward from a longitudinal axis of the bit and protruding from the lower end of the bit body;

a plurality of roller cones rotatably mounted on the plurality of journals;

a plurality of cutting elements disposed on the plurality of roller cones; and wherein the plurality of roller cones are retained on the plurality of journals by a ball bearing retainer system.

19. The drill bit of claim 18, wherein the bit body comprises, beneath the connection at an upper end of the bit body, a pair of bit breaker slots.

20. The drill bit of claim 18, wherein the plurality of journals extend downward and radially outward such that an acute angle $\phi$ranging from about 60 to less than 65 degrees is formed between a journal axis the longitudinal axis of the bit.

21. The drill bit of claim 18, wherein at least one of the plurality of journals extends downward and radially outward from a different axial location than at least one other of the plurality of journals.

22. The drill bit of claim 18, wherein at least one of the plurality of cones has a different cone size or cutting profile than at least one other of the plurality of cones.

23. The drill bit of claim 18, wherein at least cone has a positive or negative offset.

24. The drill bit of claim 18, wherein a plurality of ball passages transverse the bit body, are each a total length that is greater than the length of the radius from the longitudinal axis of the bit to a ball race opening in each of the plurality of journals.

25. The drill bit of claim 18, wherein the ball bearing retainer system comprises:

a plurality of ball passages, wherein the plurality of ball passages intersect with each other;

a ball retainer positioned in each of the ball passages, wherein a seal is disposed between the ball retainer and each ball passage;

a center plug located at the intersection of the ball passages, wherein the center plug comprises a plurality of grooves and a plurality of blind holes positioned in an alternating configuration around the circumference of the center plug; and a plurality of back plugs;

wherein a plug end of each ball retainer fits within the grooves of the center plug; and wherein each back plug fits within the blind holes of the center plug.

26. The drill bit of claim 25, wherein an epoxy material is JB welded to the center plug.

27. The drill bit of claim 18, further comprising a center insert inserted into a hole in the lower end of the bit body.

* * * * *